US011975937B2

(12) United States Patent
Kondo et al.

(10) Patent No.: US 11,975,937 B2
(45) Date of Patent: May 7, 2024

(54) FEEDING DEVICE

(71) Applicant: SEIKO EPSON CORPORATION, Tokyo (JP)

(72) Inventors: Katsuyuki Kondo, Shiojiri (JP); Junko Ao, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 261 days.

(21) Appl. No.: 17/457,779

(22) Filed: Dec. 6, 2021

(65) Prior Publication Data

US 2022/0177242 A1 Jun. 9, 2022

(30) Foreign Application Priority Data

Dec. 7, 2020 (JP) ..... 2020-202476

(51) Int. Cl.
*B65H 3/52* (2006.01)
*B65H 3/06* (2006.01)

(52) U.S. Cl.
CPC ..... *B65H 3/5215* (2013.01); *B65H 3/0669* (2013.01); *B65H 3/0684* (2013.01)

(58) Field of Classification Search
CPC ..... B65H 3/0684; B65H 3/5215
See application file for complete search history.

(56) References Cited

U.S. PATENT DOCUMENTS 9,904,228 B2 2/2018 Xie
2015/0329303 A1 11/2015 Xie
2022/0169456 A1* 6/2022 Orita ..... B65H 3/0607
2023/0227280 A1* 7/2023 Kondo ..... B65H 3/34 270/1.01
2023/0227281 A1* 7/2023 Ao ..... B65H 1/14 270/1.01

FOREIGN PATENT DOCUMENTS

CN 105084058 11/2015
JP 2018-016458 A 2/2018

* cited by examiner

*Primary Examiner* — Howard J Sanders

(74) *Attorney, Agent, or Firm* — WORKMAN NYDEGGER

(57) ABSTRACT

A feeding unit includes: a retard roller; a holder section; a protruding section; an accommodating section; a pressing section; a first restricting section; and a second restricting section. The holder section rotatably holds the retard roller. The protruding section serves as a rocking fulcrum of the holder section. The accommodating section accommodates the holder section. The pressing section presses the holder section. The first restricting section restricts movement of the holder section in a retreating direction. The second restricting section restricts movement of the holder section in a direction opposite to the retreating direction. The pressing section is arranged so as to deviate in a Y direction with respect to a virtual line passing through a middle point of the protruding section and a middle point of the first restricting section. The holder section comes into contact with the first restricting section and the second restricting section.

11 Claims, 21 Drawing Sheets

FEEDING DEVICE

The present application is based on, and claims priority from JP Application Serial Number 2020-202476, filed Dec. 7, 2020, the disclosure of which is hereby incorporated by reference herein in its entirety.

BACKGROUND

1. Technical Field

The present disclosure relates to a feeding device.

2. Related Art

A sheet transporting device of JP-A-2018-16458 includes a first holder that rotatably supports a retard roller, a second holder that accommodates the first holder, an accommodating section that accommodates the second holder, a removal assisting spring that presses the second holder upward, and a hook section that engages the second holder. A boss is provided in the second holder so as to protrude. The boss of the second holder is fit into a positioning recess of the accommodating section from above.

In the sheet transporting device of JP-A-2018-16458, the boss of the second holder is able to move upward such that the second holder is detachably attached to the accommodating section. Moreover, the configuration is such that engagement of the second holder and the hook section resists a pressing force that acts on the second holder from the removal assisting spring.

In this case, since a contact position of the second holder and the hook section and a contact position of the second holder and the removal assisting spring are substantially the same in the axial direction of the retard roller, a moment may act on the second holder around the contact position of the second holder and the hook section. In this case, since the direction in which the moment acts has not been determined, the direction in which the second holder rotates is unclear. That is, the position of the retard roller may change each time the second holder is replaced.

SUMMARY

To address the aforementioned problem, a feeding device according to an aspect of the disclosure includes: a retard roller that comes into contact with a feeding roller for feeding a medium and that is configured to rotate about a shaft; at least one holder that rotatably holds the retard roller; a protruding section that is provided in the holder and serves as a rocking fulcrum of the holder; an accommodating section that includes a holding section which holds the protruding section and that accommodates the holder; a pressing section that presses the holder in a retreating direction in which the holder separates from the accommodating section; a first restricting section that is provided in the accommodating section and restricts movement of the holder in the retreating direction; and a second restricting section that is provided in the accommodating section and restricts movement of the holder in a direction opposite to the retreating direction, in which the pressing section is arranged so as to deviate in an axial direction of the retard roller with respect to a virtual line passing through a middle point of the protruding section and a middle point of the first restricting section in the axial direction, and the holder comes into contact with the first restricting section and the second restricting section.

DESCRIPTION OF EXEMPLARY EMBODIMENTS

Figure 1:
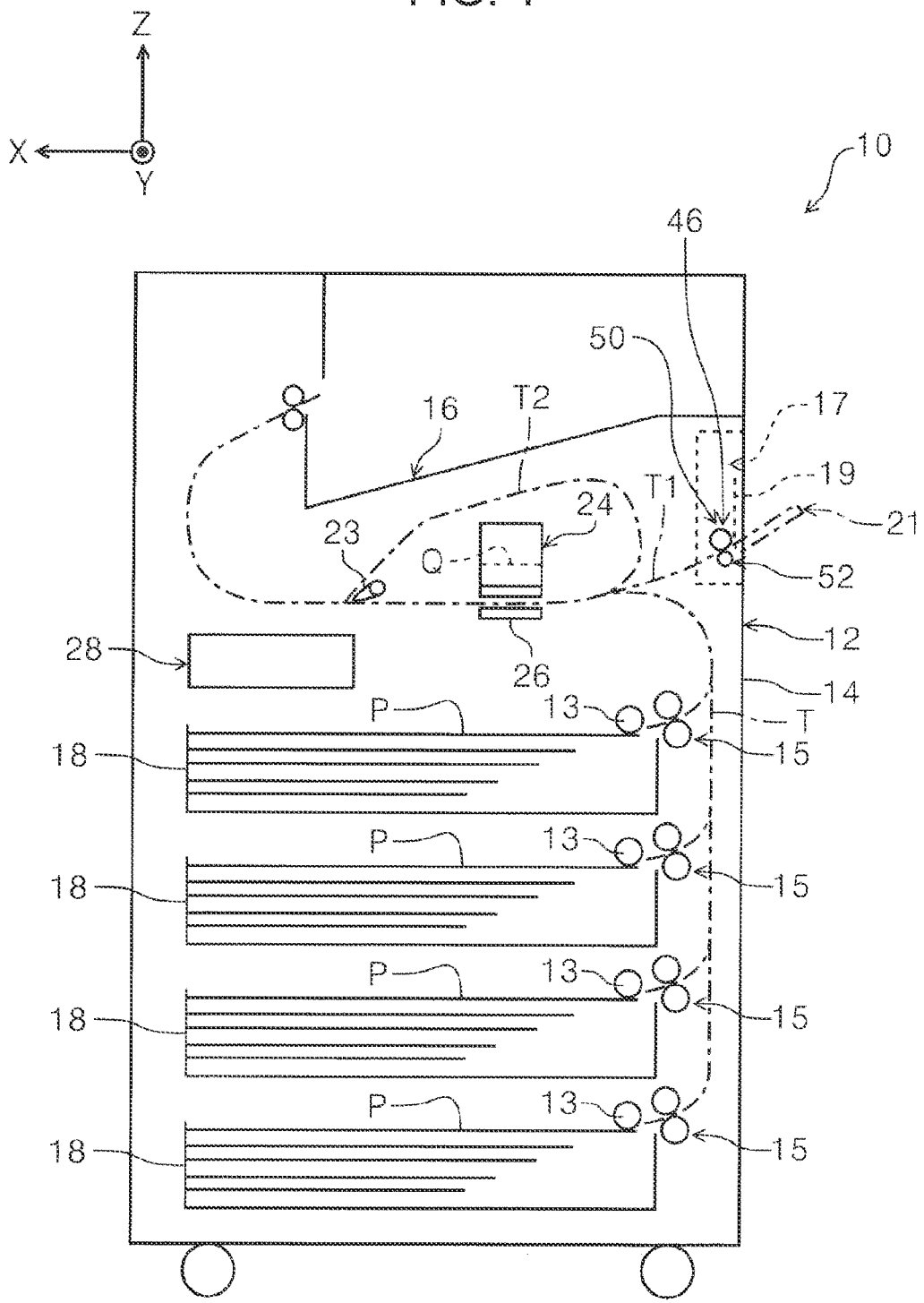
FIG. 1 illustrates an entire configuration of a feeding unit and a printer according to an embodiment.

The disclosure will be schematically described below.

A feeding device according to a first aspect includes: a retard roller that comes into contact with a feeding roller for feeding a medium and that is configured to rotate about a shaft; at least one holder that rotatably holds the retard roller; a protruding section that is provided in the holder and serves as a rocking fulcrum of the holder; an accommodating section that includes a holding section which holds the protruding section and that accommodates the holder; a pressing section that presses the holder in a retreating direction in which the holder separates from the accommodating section; a first restricting section that is provided in the accommodating section and restricts movement of the holder in the retreating direction; and a second restricting section that is provided in the accommodating section and restricts movement of the holder in a direction opposite to the retreating direction, in which the pressing section is arranged so as to deviate in an axial direction of the retard roller with respect to a virtual line passing through a middle point of the protruding section and a middle point of the first restricting section in the axial direction, and the holder comes into contact with the first restricting section and the second restricting section.

According to the present aspect, the pressing section is arranged so as to deviate in the axial direction with respect to the virtual line. Accordingly, a rotational direction of the holder rotating about the protruding section is determined to a single direction.

Moreover, a pressing force that acts on the holder from the pressing section retains a state in which the protruding section and the holding section are in contact with each other. That is, the position of the center of rotation of the holder is suppressed from deviating.

Further, movement of the holder in the retreating direction is restricted by the first restricting section, movement of the holder in the direction opposite to the retreating direction is restricted by the second restricting section, and the holder is thereby positioned at a predetermined position.

Here, since the holder is positioned at a predetermined position each time the holder and the retard roller are attached to or detached from the accommodating section, the position of the holder with respect to the feeding device does not change before and after the retard roller is replaced, and it is possible to suppress the position of the retard roller from changing each time the retard roller is replaced.

The feeding device according to a second aspect further includes a second pressing section, in which the holder includes a first holder that rotatably holds the retard roller and a second holder that holds the first holder in a pivotable position, the pressing section functions as a first pressing section, and the second pressing section presses the first holder such that the retard roller comes into contact with the feeding roller.

According to the present aspect, since the first holder that holds the retard roller is pivotable with respect to the second holder, it is possible to change the position of the retard roller. Further, the second pressing section is provided separately from the first pressing section and is thus able to press the retard roller against the feeding roller regardless of a pressing state of the first holder.

According to a third aspect, in the feeding device of the second aspect, the second holder includes a guiding member that guides the medium toward the feeding roller.

According to the present aspect, when the second holder is accommodated in the accommodating section, the second holder is positioned at a predetermined position, and the guiding member is thus positioned upstream of the feeding roller in a feeding direction of the medium. Accordingly, it is unnecessary to separately perform operation of adjusting a position at which the guiding member is attached, after the second holder is accommodated in the accommodating section. That is, even when the second holder is detached from the accommodating section to replace the retard roller, the position of the second holder with respect to the feeding device does not change before and after the retard roller is replaced, and it is thus unnecessary to separately perform the operation of adjusting the position at which the guiding member is attached, after the retard roller is replaced.

According to a fourth aspect, in the feeding device of the third aspect, a changing section configured to change a position of the guiding member in a direction intersecting the axial direction is provided in at least one of the guiding member and the second holder.

According to the present aspect, since the position of the guiding member in the intersecting direction is able to be changed, it is possible to provide the guiding member in the second holder such that a leading end of the medium advances toward a contact portion of the retard roller and the feeding roller.

According to a fifth aspect, in the feeding device of the fourth aspect, the changing section includes a third pressing section that presses the guiding member toward the feeding roller.

According to the present aspect, when the position of the guiding member is changed, a pressing force that acts on the guiding member from the third pressing section resists the gravity that acts on the guiding member. Accordingly, the guiding member is supported, and it is thus possible to facilitate changing the position of the guiding member.

According to a sixth aspect, in the feeding device of any one of the second to fifth aspects, the first pressing section is arranged in one of a first region and a second region that are divided by the virtual line, and the second restricting section is arranged in the other of the first region and the second region.

According to the present aspect, the first pressing section is arranged on one side with respect to the virtual line, and the second restricting section is arranged on the other side with respect to the virtual line. In other words, since a portion of the second holder, which is pressed, and a portion of the second holder, at which movement is restricted, are able to be arranged so as to be apart from each other, it is possible to stabilize a posture of the second holder.

According to a seventh aspect, in the feeding device of the sixth aspect, the first pressing section is arranged in a smaller one of the first region and the second region.

Since the first holder holds the retard roller, the first holder is necessarily arranged in the larger one of the first region and the second region.

In this case, according to the present aspect, compared with a configuration in which the first pressing section is arranged in the larger one of the first region and the second region, it is possible to arrange the first pressing section so as to be apart from the first holder, thus making it possible to suppress the first pressing section from coming into contact with the first holder.

According to an eighth aspect, in the feeding device of any one of the second to seventh aspects, in a state in which the second holder is accommodated in the accommodating section and in which the first restricting section restricts movement of the second holder, the first pressing section and the first restricting section overlap each other in the axial direction.

According to the present aspect, compared with a configuration in which the first pressing section and the first restricting section are arranged so as to deviate in the axial direction, it is possible to suppress another moment around a line passing through the first pressing section and the first restricting section from affecting positioning of the second holder.

In any one of the second to eighth aspects, the feeding device according to a ninth aspect further includes: a releasing section; and a cover member, in which the first restricting section is provided so as to be movable between a restricting position at which the first restricting section restricts movement of the second holder in the accommodating section and a releasing position at which the first restricting section is separated from the restricting position, the releasing section moves the first restricting section to the releasing position, and the cover member covers the releasing section in a state in which the cover member is attached to a device main body.

According to the present aspect, since the cover member covers the releasing section in the state in which the cover member is attached to the device main body, it is possible to suppress erroneous operation of releasing the releasing section. Note that, by detaching the cover member from the device main body, it is possible to perform operation of releasing the releasing section.

According to a tenth aspect, in the feeding device of any one of the second to ninth aspects, the first holder includes an operation section, and the retard roller separates from the feeding roller when the operation section is operated.

According to the present aspect, when the operation section of the first holder is operated, the retard roller separates from the feeding roller. Accordingly, it is unnecessary to grasp the entire first holder to operate the first holder, thus making it possible to facilitate operation of replacing the feeding roller or the retard roller.

A printer 10 that includes a feeding unit 50, which is an example of a feeding device according to the disclosure, will be specifically described below as an embodiment.

FIG. 1 illustrates the printer 10. The printer 10 is configured as an ink jet apparatus that ejects ink Q, which is an example of a liquid, onto a sheet P, which is an example of a medium, to perform recording. Note that the X-Y-Z coordinate system illustrated in each drawing is an orthogonal coordinate system.

The X direction is an apparatus width direction when viewed by a user facing the printer 10 and is a horizontal direction. In the X direction, a direction toward the left is the +X direction, and a direction toward the right is the −X direction.

The Y direction is a width direction of the sheet P, which intersects a transport direction of the sheet P, an apparatus depth direction, and a horizontal direction. In the Y direction, a direction toward the front is the +Y direction, and a direction toward the rear is the −Y direction.

The Z direction is an apparatus height direction and, for example, the vertical direction. In the Z direction, an upward direction is the +Z direction, and a downward direction is the −Z direction.

In the printer 10, the sheet P is transported on a transport path T indicated by the broken line.

The printer 10 includes a main body section 12. The main body section 12 includes a housing 14 constituting the contour of the printer 10.

An end portion of the housing 14 in the −X direction includes a door section 17 that stands upright in the Z direction. An opening section 19 that is open toward the −X direction is formed in the door section 17. Moreover, a paper feeding tray 21 that is able to open/close the opening section 19 is provided in the door section 17.

The paper feeding tray 21 is supported by a hinge section (not illustrated) provided in an edge portion of the opening section 19 in the −Z direction so as to be rotatable with the Y direction as the axial direction. The paper feeding tray 21 in a state of standing upright in the Z direction closes the opening section 19. The paper feeding tray 21 in an inclined state in which the end portion in the +X direction is positioned in the −Z direction with respect to the end portion in the −X direction opens the opening section 19. In such a manner, the paper feeding tray 21 is opened/closed in the up-down direction.

A discharging section 16 to which the sheet P subjected to recording is discharged is formed in a portion of the housing 14 in the +Z direction with respect to the center of the housing 14 in the Z direction. A plurality of cassettes 18 are provided in the housing 14. Sheets P are accommodated in the plurality of cassettes 18. A sheet P accommodated in the cassettes 18 is transported on the transport path T by a pick-up roller 13 and a transporting roller pair 15.

The transport path T merges with a transport path T1. The transport path T1 is a path on which the sheet P is transported from the paper feeding tray 21 by the feeding unit 50 described below. Moreover, the transport path T merges with an inversion path T2 on which the front side and the rear side of the sheet P are inverted. Furthermore, a plurality of transporting roller pairs (not illustrated) that transport the sheet P, a flap 23 that switches a transport path, and a sensor (not illustrated) that detects the width of the sheet P in the Y direction are arranged on the transport path T.

Moreover, a recording head 24 that performs recording on the sheet P and a support 26 that supports the sheet P at a position facing the recording head 24 are arranged on the transport path T.

The main body section 12 includes a control section 28.

The control section 28 includes a CPU (central processing unit), ROM (read-only memory), RAM (random access memory), and storage, which are not illustrated, and controls transportation of the sheet P in the printer 10 and operation of the respective sections and the recording head 24.

Figure 2:
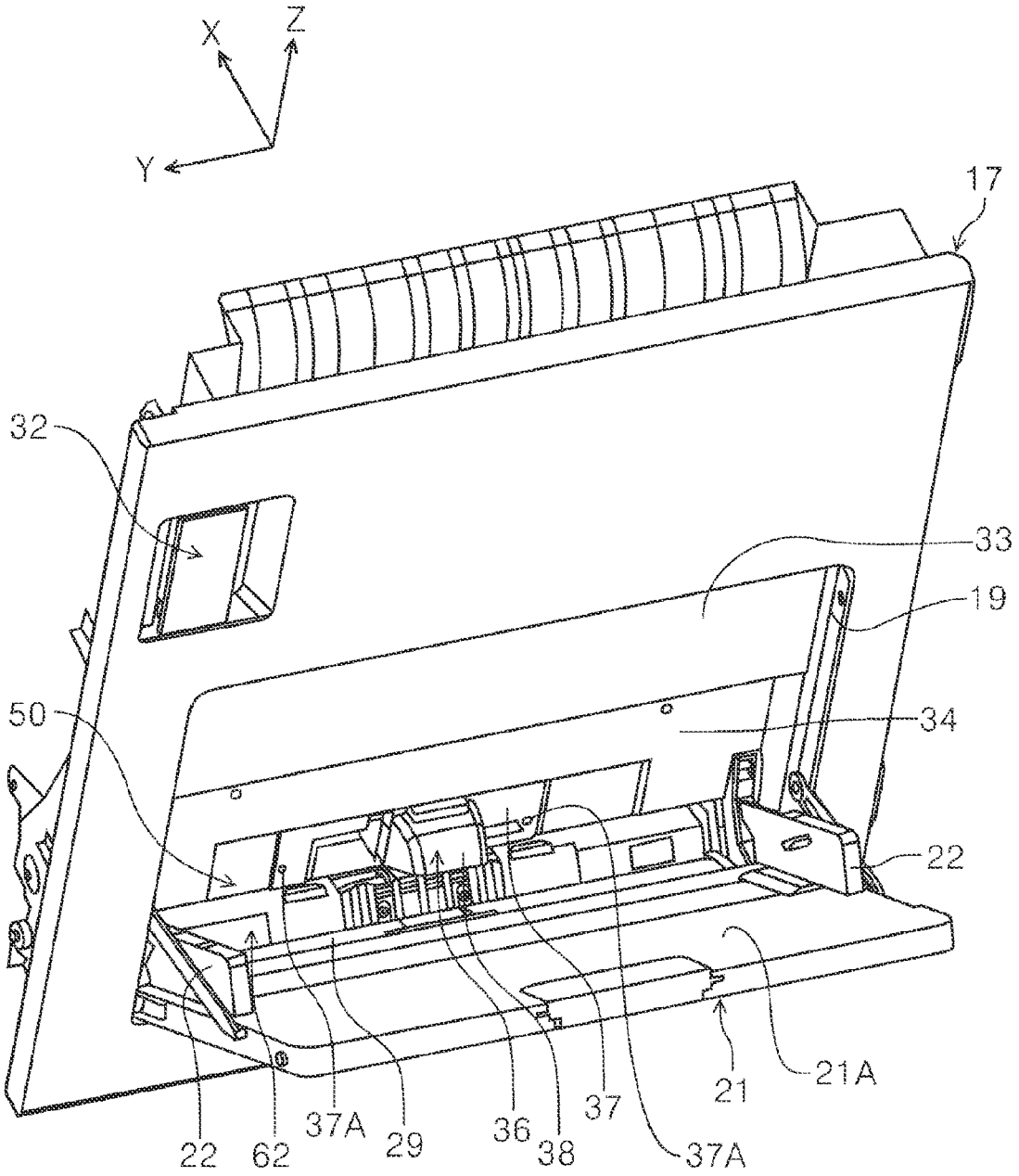
FIG. 2 is a perspective view illustrating the feeding unit according to the embodiment in a state in which a paper feeding tray is open.

As illustrated in FIG. 2, the door section 17 is constituted by an opening/closing member that opens/closes a portion of the housing 14 (FIG. 1). The door section 17 has a quadrangular shape including sides extending in the Y direction and sides extending in the Z direction when viewed in the +X direction. The end portion of the door section 17 in the −Y direction is supported by a hinge section (not illustrated) so as to be rotatable with respect to the housing 14.

A lock section 32 is provided in the end portion of the door section 17 in the +Y direction. The lock section 32 locks or unlocks the door section 17 with respect to the housing 14. In such a manner, the door section 17 is opened/closed in a horizontal direction.

In the door section 17, an upper wall 33 and a lower wall 34 are provided in the +X direction of the opening section 19.

The upper wall 33 extends in the Y direction. Moreover, the upper wall 33 comes into contact with the end portion of the paper feeding tray 21 in the +Z direction, which stands upright.

The lower wall 34 is provided at a position in the −Z direction and the +X direction of the upper wall 33 and extends in the Y direction. In the lower wall 34, a roller cover 36 is provided in the center portion in the Y direction and in a portion in the −Z direction. A base guide 62 described below is provided in the −Z direction of the lower wall 34.

The roller cover 36 is an example of a cover member and is included in the feeding unit 50 described below. The roller cover 36 includes an attaching section 37 having a plate-like shape and a grasping section 38 protruding from the attaching section 37.

The attaching section 37 has a rectangular shape in which the dimension in the Y direction is longer than the dimension in the Z direction when viewed in the X direction. A through hole 37A through which a screw (not illustrated) is inserted is formed in each end portion of the attaching section 37 in the Y direction. In the door section 17, an attached section (not illustrated) to which the attaching section 37 is attached by using screws is provided in the +X direction of the through holes 37A. Note that the roller cover 36 is detachable from the door section 17 when the screws are removed.

The grasping section 38 protrudes in the −X direction from the center portion of the attaching section 37 in the Y direction. The grasping section 38 may be grasped by a user from the −Z direction side. When the user grasps the grasping section 38 to tighten or loosen a screw, the roller cover 36 is suppressed from dropping.

Note that, in a state in which the roller cover 36 is attached to the door section 17, the roller cover 36 covers a feeding roller 46 (FIG. 3), an operation section 112 (FIG. 10), and a releasing section 164 (FIG. 14), which are described below, from the +Z direction side and the −X direction side.

On the other hand, in a state in which the roller cover 36 is detached from the door section 17, the feeding roller 46, the operation section 112, and the releasing section 164 are exposed in the +Z direction and the −X direction.

The paper feeding tray 21 has a plate-like shape. Moreover, the paper feeding tray 21 includes a mounting surface 21A on which the sheet P is mounted. Side guides 22 are provided on the mounting surface 21A. The side guides 22 align both edges of a plurality of sheets P, stacked on the mounting surface 21A, in the Y direction. The side guides 22 are accommodated in a stepped portion of the upper wall 33 and the lower wall 34.

A lifter 29 that raises/lowers leading ends of the sheets P, which are stacked on the mounting surface 21A, in the +X direction is provided between the side guides 22 and the base guide 62 described below.

Figure 3:
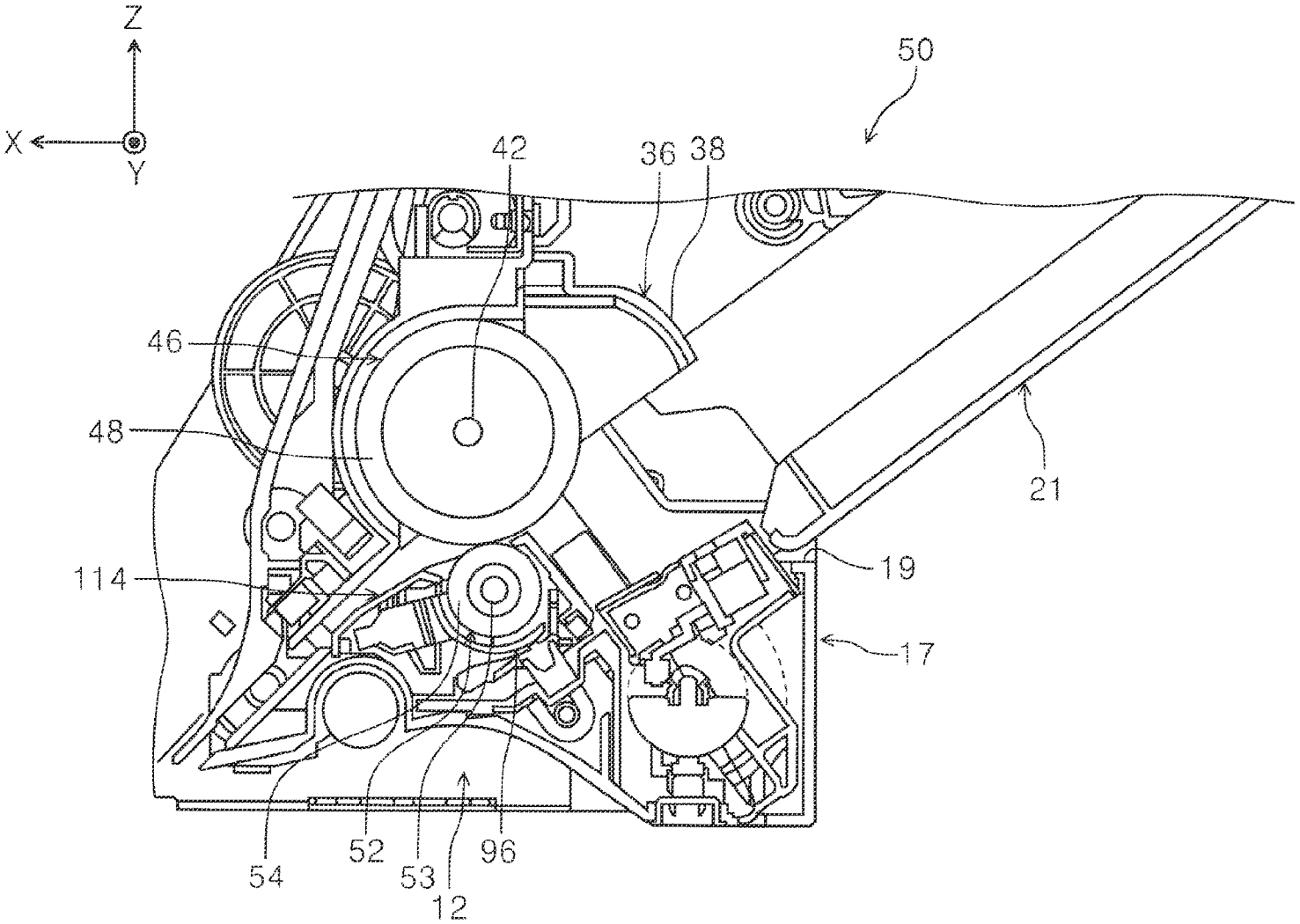
FIG. 3 is a vertical sectional view illustrating the feeding unit according to the embodiment in the state in which the paper feeding tray is open.

As illustrated in FIG. 3, a drive shaft 42 and the feeding roller 46 are provided in a portion of the main body section 12 which faces the paper feeding tray 21 in the X direction.

The drive shaft 42 has a cylindrical shape in which the axial direction is the Y direction. The end portion of the drive shaft 42 in the −Y direction is supported by the main body section 12 by using a bearing (not illustrated) so as to be rotatable. The end portion of the drive shaft 42 in the −Y direction is provided with a gear (not illustrated). The gear is rotated by a motor (not illustrated).

Figure 5:
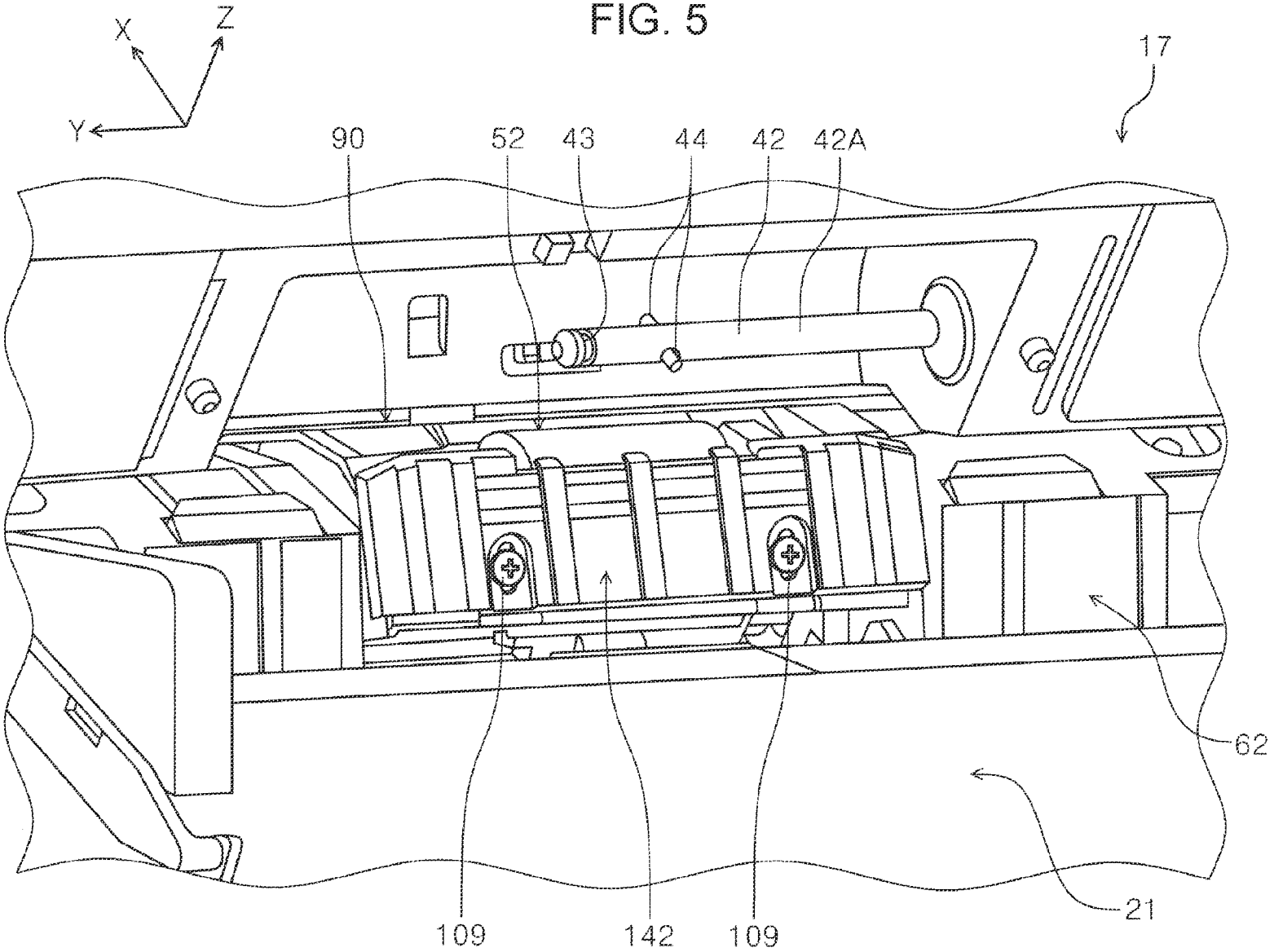
FIG. 5 is a perspective view illustrating the state in which the feeding roller is detached from the feeding unit according to the embodiment.

As illustrated in FIG. 5, an engaging groove 43 is formed in the entire +Y-direction end portion of the drive shaft 42 in the circumferential direction. Furthermore, two pins 44 are provided in a portion of the drive shaft 42 in the −Y direction of the engaging groove 43.

Each of the two pins 44 protrudes in a radial direction from an outer peripheral surface 42A of the drive shaft 42. The two pins 44 are arranged with a gap therebetween in the circumferential direction of the drive shaft 42. Note that each of the two pins 44 is pressed radially outward by a spring (not illustrated). In this instance, when an external radially inward force acts on the two pins 44, the two pins 44 are able to retreat to positions at which the two pins 44 are aligned with the outer peripheral surface 42A in the radial direction.

Figure 6A:
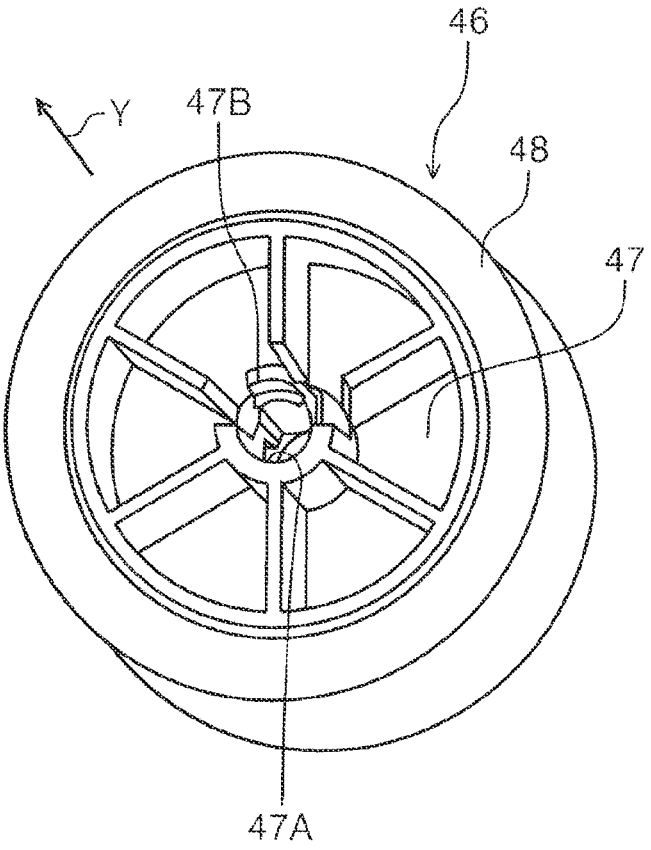
FIG. 6A is a perspective view illustrating the feeding roller of the printer according to the embodiment when viewed from one side in the axial direction.
Figure 6B:
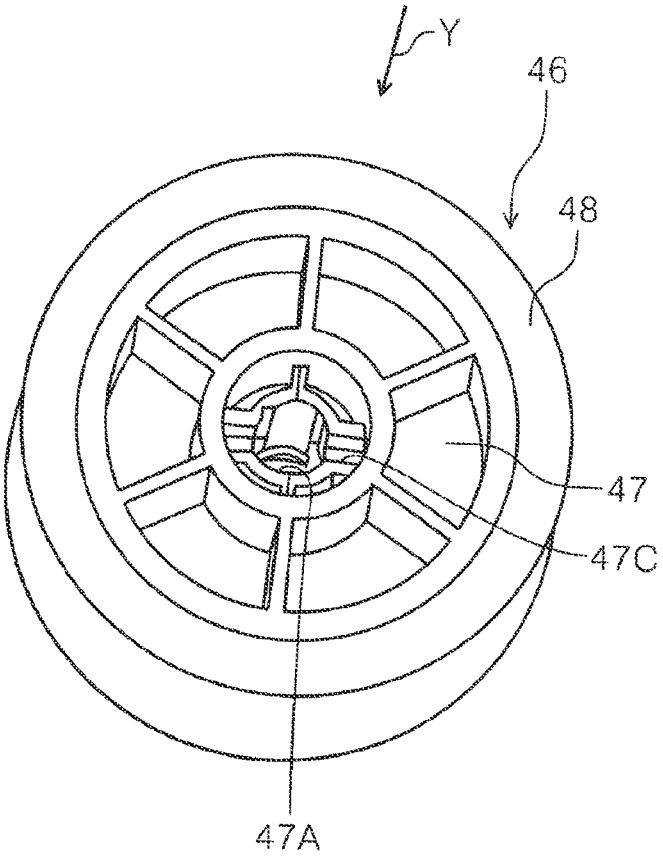
FIG. 6B is a perspective view illustrating the feeding roller of the printer according to the embodiment when viewed from the other side in the axial direction.

The drive shaft 42 and the feeding roller 46 will be described with reference to FIGS. 5, 6A, and 6B.

The feeding roller 46 includes a roller main body 47 that has a cylindrical shape and an elastic section 48 that covers the outer peripheral surface of the roller main body 47. The feeding roller 46 is arranged such that the axial direction is the Y direction.

An insertion hole 47A is formed in the center of the roller main body 47. The drive shaft 42 is inserted into the insertion hole 47A. A pawl section 47B is formed in the +Y-direction edge portion of the insertion hole 47A of the roller main body 47. The pawl section 47B is able to engage the engaging groove 43.

The elastic section 48 is formed of, for example, a rubber cylinder.

A groove section 47C is formed in the −Y-direction edge portion of the insertion hole 47A of the roller main body 47. The groove section 47C is able to engage the two pins 44. Note that the end surface of the groove section 47C is inclined so as to guide the two pins 44 to the groove section 47C.

In a state in which the pins 44 are inserted into the insertion hole 47A, when the two pins 44 engage the groove section 47C and, furthermore, the pawl section 47B engages the engaging groove 43, the drive shaft 42 and the feeding roller 46 are integrated. The feeding roller 46 feeds the sheet P downstream in a feeding direction in accordance with rotation.

On the other hand, when the pawl section 47B disengages the engaging groove 43 and, furthermore, the two pins 44 disengage the groove section 47C, the feeding roller 46 is detached from the drive shaft 42.

Next, the feeding unit 50 will be described.

Figure 4:
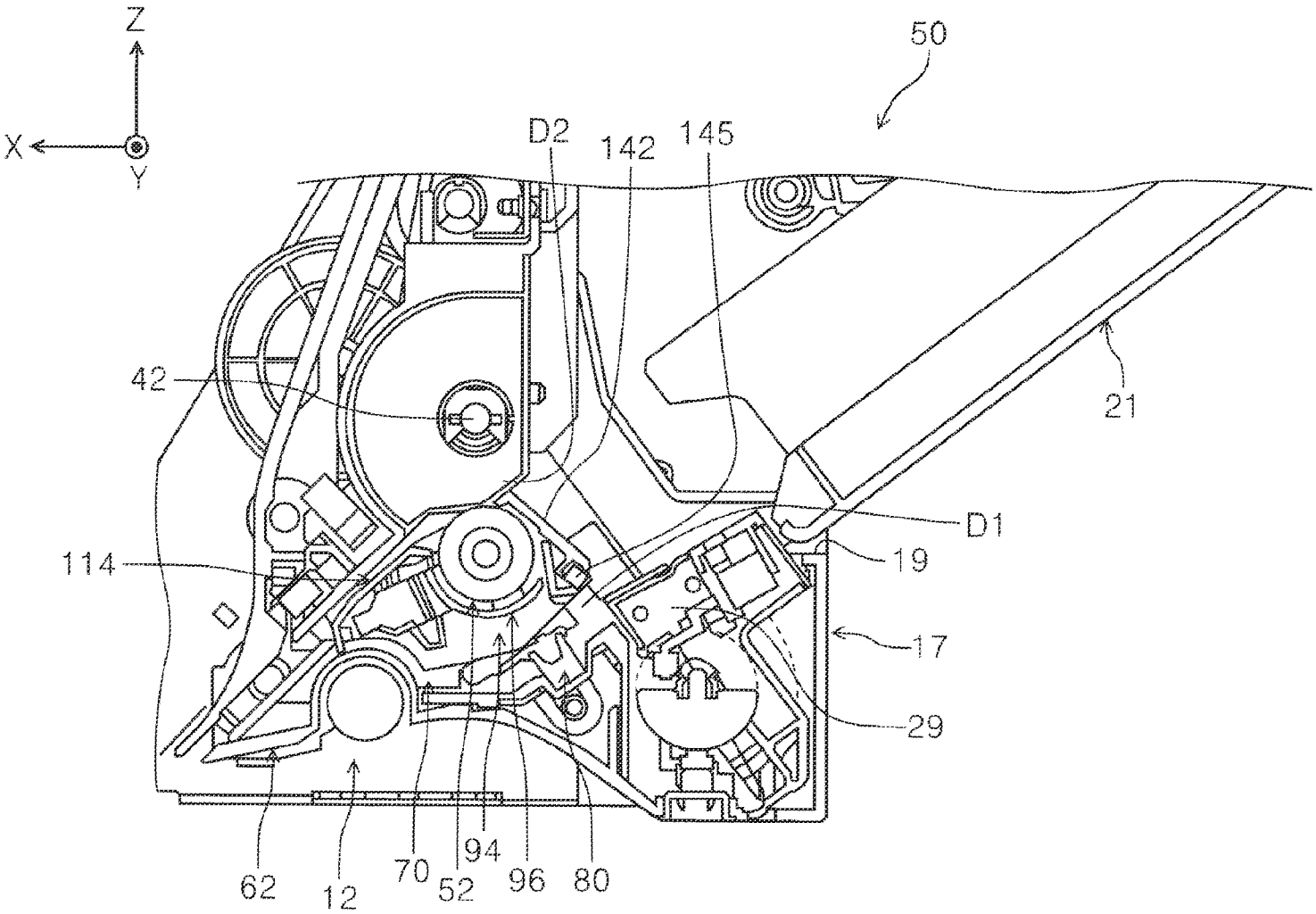
FIG. 4 is a vertical sectional view illustrating a state in which a feeding roller is detached from the feeding unit according to the embodiment.
Figure 8:
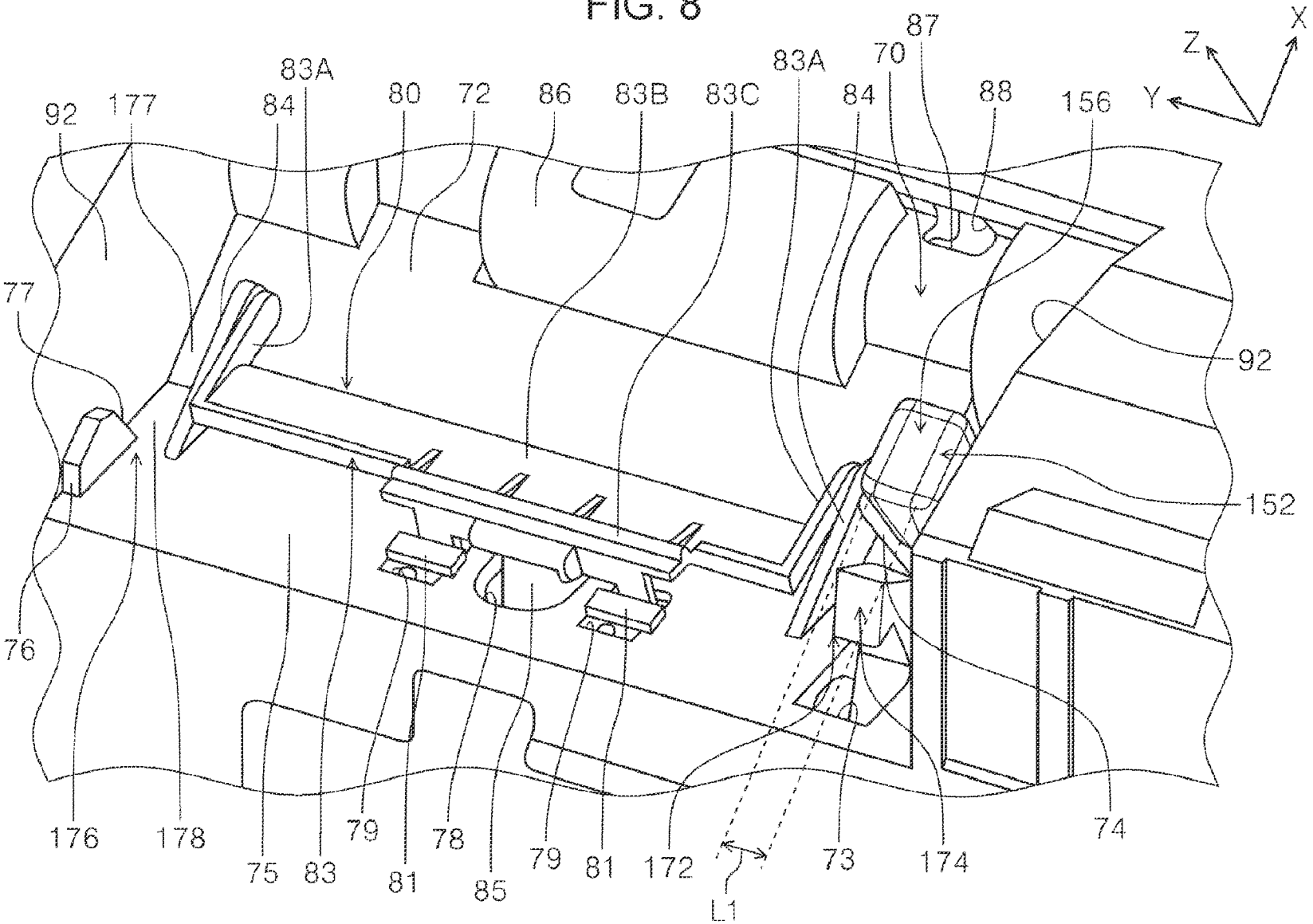
FIG. 8 is a partially enlarged perspective view illustrating a state in which the attachable/detachable unit is detached from the base guide of the feeding unit according to the embodiment.

As illustrated in FIG. 4, the feeding unit 50 includes a retard roller 52, a holder section 94, a protruding section 132 (FIG. 12), an accommodating section 70 provided in the base guide 62, a pressing section 152, a second pressing section 80, a first restricting section 172, and a second restricting section 176 (FIG. 8).

Furthermore, the feeding unit 50 includes a guide plate 142, a changing section 145, a release lever 162 (FIG. 14), and the roller cover 36 (FIG. 2).

Note that, in the present embodiment, the apparatus main body includes, for example, a portion of the main body section 12, the door section 17, and the base guide 62.

As illustrated in FIG. 3, the retard roller 52 includes a shaft section 53 that extends in the Y direction and an elastic section 54 that covers the circumference of the shaft section 53 and has a cylindrical shape. The outer peripheral surface of the elastic section 54 comes into contact with the outer peripheral surface of the elastic section 48. That is, the retard roller 52 comes into contact with the feeding roller 46 and rotates about the axis of the shaft section 53. Note that, when viewed in the Y direction, a rotational direction of the retard roller 52 is opposite to a rotational direction of the feeding roller 46. Accordingly, a single sheet P of a plurality of sheets P is separated from the other sheets P and fed, and the other sheets P remain in place.

The outer diameter of the retard roller 52 is smaller than the outer diameter of the feeding roller 46. A torque limiter 55 (FIG. 11) is provided in a portion of the shaft section 53.

Figure 7:
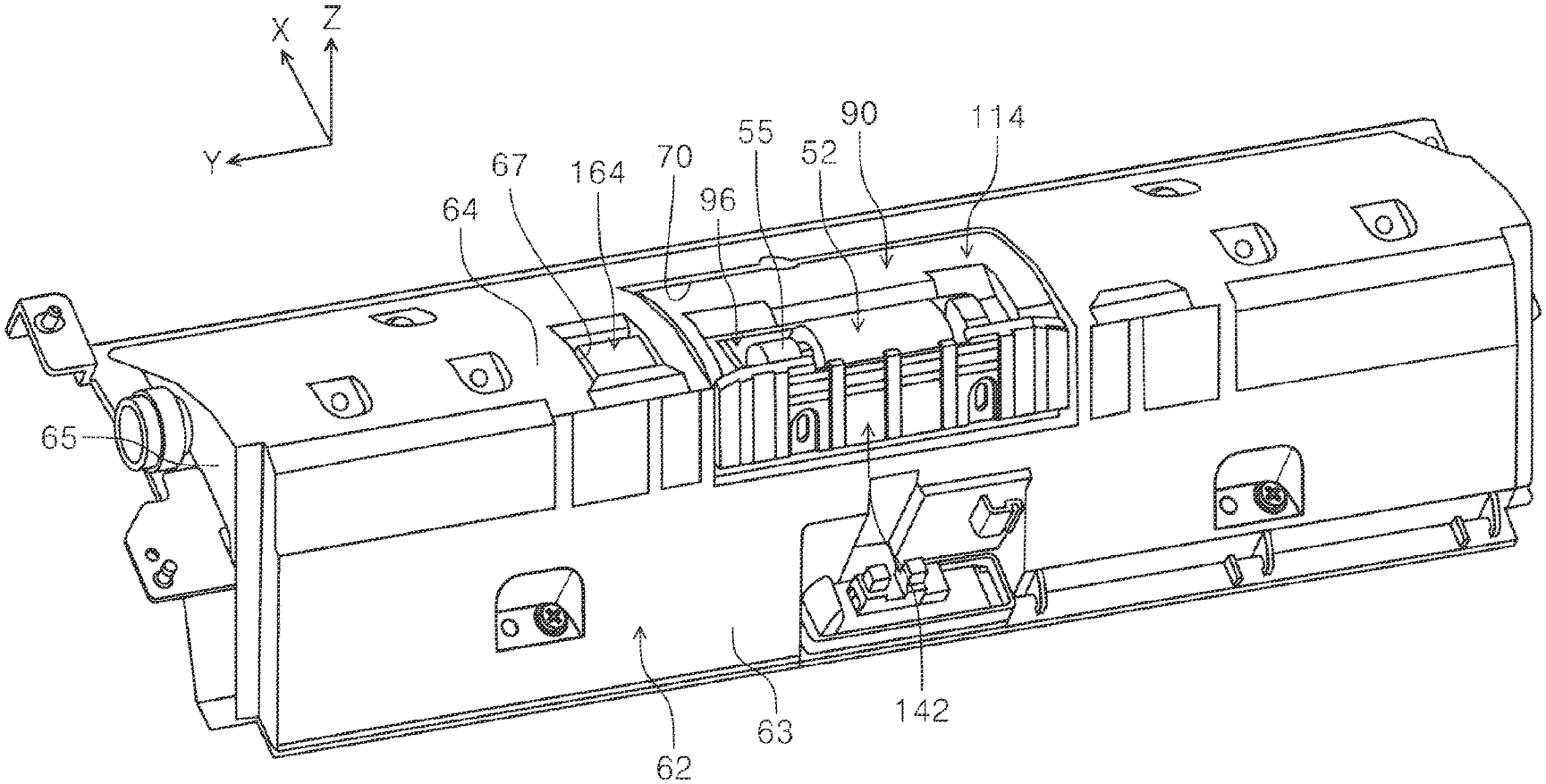
FIG. 7 is a perspective view illustrating a base guide and an attachable/detachable unit of the feeding unit according to the embodiment.

As illustrated in FIG. 7, the base guide 62 is formed of, for example, resin and has a column shape extending in the Y direction. The base guide 62 is arranged in the −Z direction of the transport path T1 (FIG. 1). Specifically, the base guide 62 includes a front wall section 63 arranged so as to face the paper feeding tray 21 (FIG. 1), a top wall section 64 extending from the end portion of the front wall section 63 in the +Z direction along the transport path T1, side wall sections 65 positioned in the ends in the Y direction, and the accommodating section 70.

The accommodating section 70 is formed over the center portion of the front wall section 63 in the Y direction and the center portion of the top wall section 64 in the Y direction. Specifically, the accommodating section 70 is formed as a recess which is open in the +Z direction.

A through hole 67 passing through the top wall section 64 in the Z direction is formed in a +Y-direction portion of the accommodating section 70 in the top wall section 64. The through hole 67 has, for example, a rectangular shape.

Figure 9:
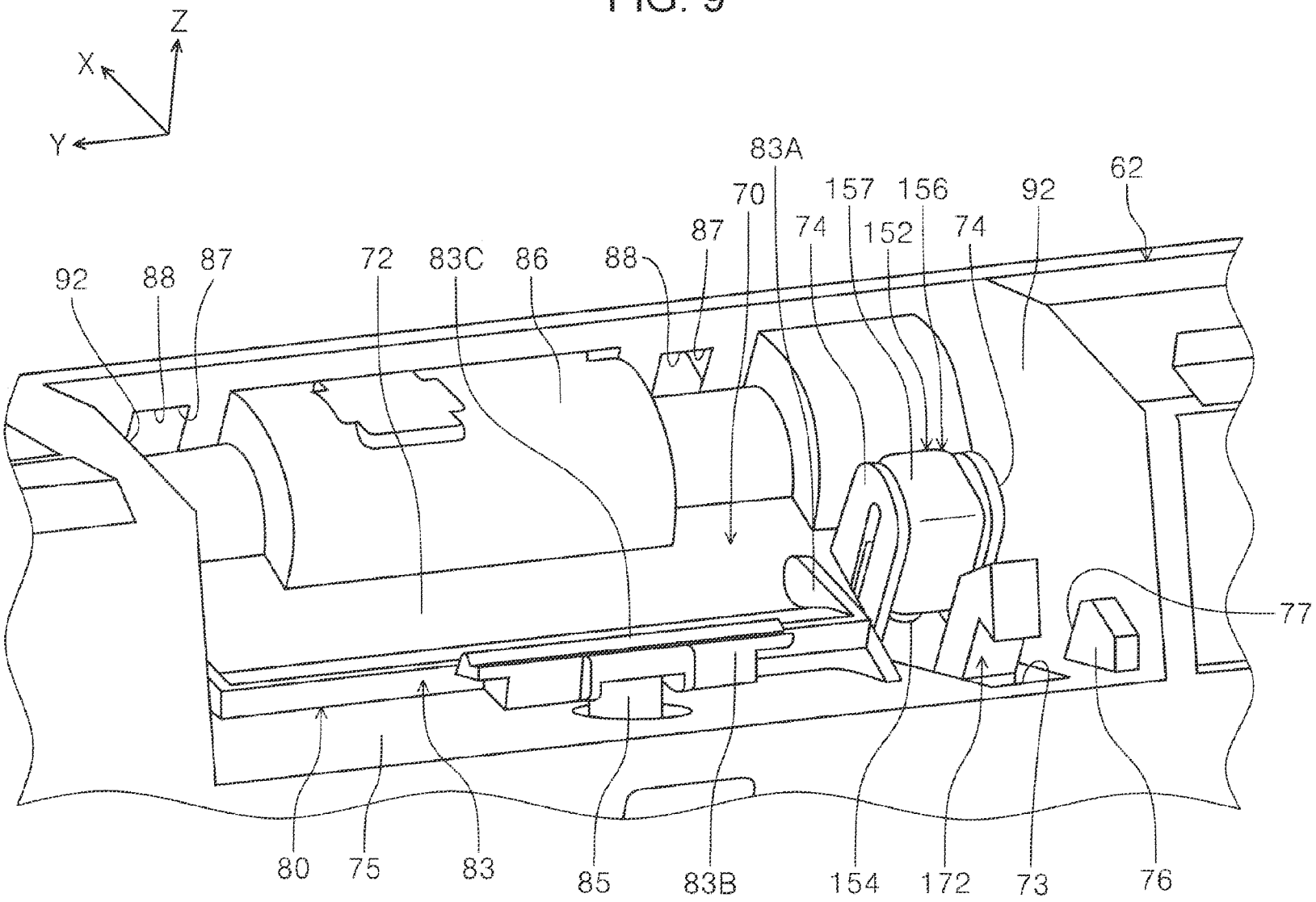
FIG. 9 is a partially enlarged perspective view illustrating the state in which the attachable/detachable unit is detached from the base guide of the feeding unit according to the embodiment.
Figure 10:
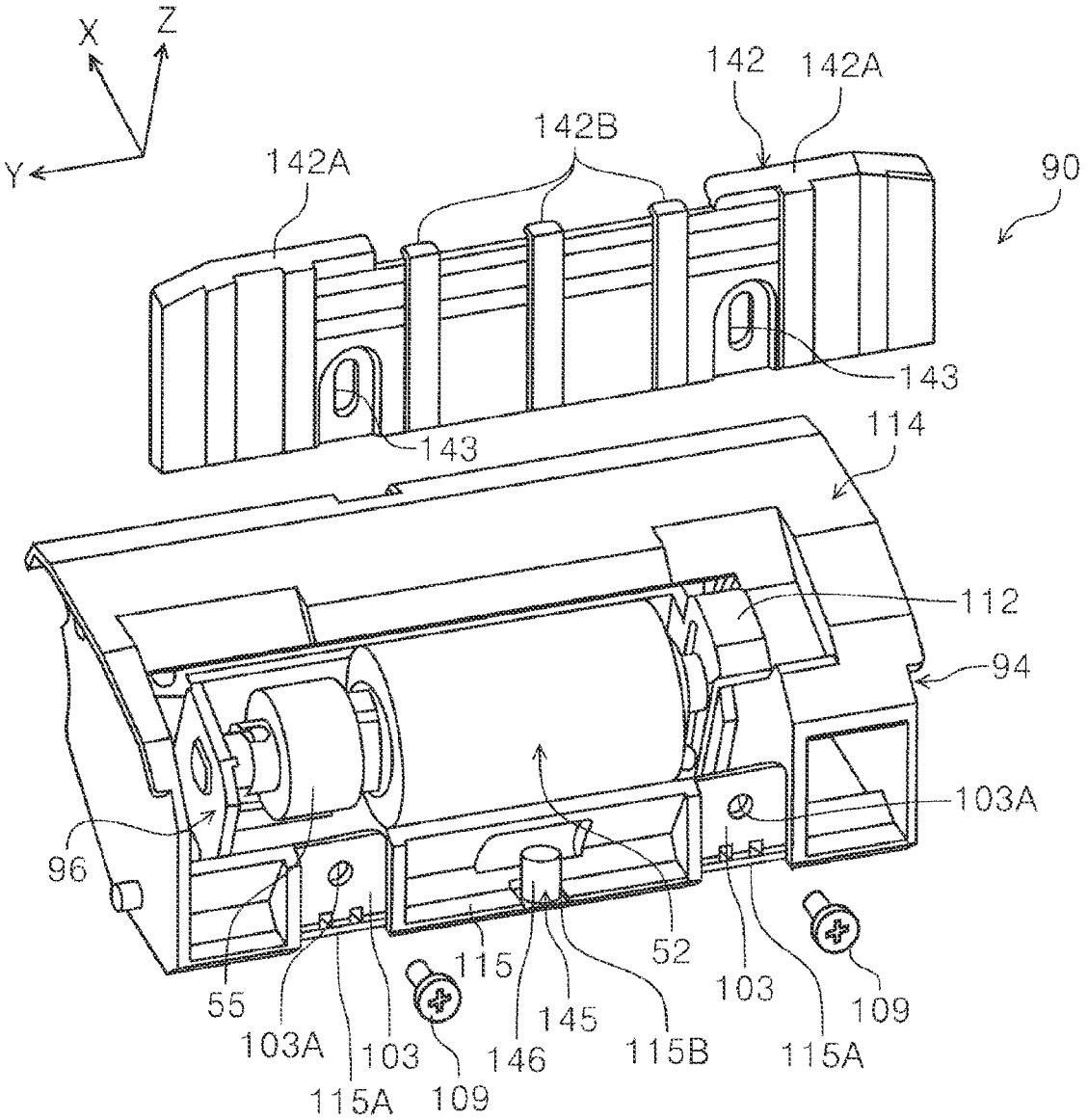
FIG. 10 is a perspective view in which a portion of the attachable/detachable unit of the feeding unit according to the embodiment is disassembled.

As illustrated in FIGS. 8 and 9, the accommodating section 70 is a portion enclosed by, for example, a bottom wall 72, a front wall 75, a rear wall 86, and two inner walls 92. Moreover, the accommodating section 70 includes an edge section 88 described below and accommodates the holder section 94 (FIG. 10). Further, the accommodating section 70 is provided with a pressing lever 83 and a coil spring 85.

The bottom wall 72 is arranged substantially in the X-Y plane. The bottom wall 72 has a rectangular shape in which the dimension in the X direction is shorter than the dimension in the Y direction. A through hole 73 is formed in the end portion of the bottom wall 72 in the −Y direction. In the edge portions of the through hole 73, which face each other in the Y direction, two guide walls 74 are provided with a gap therebetween in the Y direction. The two guide walls 74 stand upright from the bottom wall 72 in the +Z direction.

The front wall 75 extends from the end portion of the bottom wall 72 in the −X direction in an obliquely upward direction intersecting the X direction. The front wall 75 has a rectangular shape in which the dimension in the X direction is shorter than the dimension in the Y direction. Two protrusions 76 each of which protrudes from the front wall 75 in the +X direction and the +Z direction are provided in the end portions of the front wall 75 in the Y direction. The two protrusions 76 are shorter than the inner walls 92 described below.

A contact surface 77 is formed in each of the end portions of the two protrusions 76 in the +X direction. The contact surface 77 is, for example, a planar surface in the Y-Z plane.

A round through hole 78 is formed in the center portion of the front wall 75 in the Y direction. Moreover, an insertion hole 79 is formed in each of the +Y-direction portion and the −Y-direction portion with respect to the through hole 78 in the front wall 75. A stopper section 81 that extends in the Y direction and has a rectangular column shape is provided over edge portions of each of the insertion holes 79.

In the front wall 75, the through hole 73 described above is formed so as to be located in the −Y direction with respect to the insertion hole 79 on the −Y direction side and located in the +Y direction with respect to the protrusion 76.

Two ribs 84 are provided in the bottom wall 72 and the front wall 75.

The two ribs 84 are arranged with a gap therebetween in the Y direction. The two ribs 84 couple the bottom wall 72 and the front wall 75. Furthermore, the two ribs 84 have a plate-like shape having a predetermined thickness in the Y direction. In the end portion of each of the two ribs 84 in the +X direction, a coupling hole (not illustrated) passing through the rib 84 in the Y direction is formed.

The rear wall 86 is curved so as to cover a plurality of rollers (not illustrated). Two through holes 87 are formed in the end portion of the rear wall 86 in the +X direction with a gap therebetween in the Y direction. Each of the through holes 87 has a rectangular shape having sides extending in the Y direction when viewed in the passing-through direction. A +X-direction portion of the edge portion of the through hole 87 is the edge section 88.

The edge portion 88 is an example of a holding section. The edge section 88 is a portion that supports the protruding section 132 (FIG. 12) described below.

The inner walls 92 stand upright in the +Z direction from edge portions of each of the bottom wall 72, the front wall 75, and the rear wall 86 in the Y direction. The inner walls 92 are arranged in the X-Z plane.

The second pressing section 80 presses a first holder 96 (FIG. 11) described below such that the retard roller 52 comes into contact with the feeding roller 46. Specifically, the second pressing section 80 includes, for example, the pressing lever 83 and the coil spring 85.

The coil spring 85 is attached to a frame (not illustrated), passes through the through hole 78, and protrudes from the front wall 75 in the +Z direction.

The pressing lever 83 includes, for example, two arm sections 83A, a cap section 83B, and a contact section 83C.

The two arm sections 83A are arranged with a gap therebetween in the Y direction and extend in the X direction. A coupling pin (not illustrated) extending outward in the Y direction is formed in the +X-direction end portion of each of the two arm sections 83A. The coupling pin is coupled to the coupling hole (not illustrated) of the rib 84. The pressing lever 83 is thereby rotatable about the coupling pins.

The cap section 83B couples, in the Y direction, the −X-direction end portions of the two arm sections 83A. The cap section 83B is attached to the end portion of the coil spring 85 in the +Z direction.

The contact section 83C is a portion protruding in the +Z direction in the center portion of the cap section 83B of the Y direction. The contact section 83C has a hemicylindrical shape.

In this manner, the pressing lever 83 is pressed by the coil spring 85 in the +Z direction. When a curved wall 99 (FIG. 11) described below comes into contact with the contact section 83C from the −Z direction side, the contact section 83C presses the first holder 96 (FIG. 11) described below in the +Z direction.

As illustrated in FIG. 10, the holder section 94 includes, as examples of a holder, the first holder 96 that rotatably holds the retard roller 52 and a second holder 114 that holds the first holder 96 in a pivotable position. That is, the holder section 94 rotatably holds the retard roller 52. Moreover, the holder section 94 comes into contact with the first restricting section 172 and the second restricting section 176 (FIG. 8) which are described below.

The holder section 94 is accommodated in the accommodating section 70 (FIG. 8). Note that at least a portion of the holder section 94 in the +Z direction is exposed from the base guide 62.

Here, the retard roller 52, the torque limiter 55, the holder section 94, and the guide plate 142 described below are collectively referred to as an attachable/detachable unit 90. The attachable/detachable unit 90 is attachable to and detachable from the accommodating section 70.

Figure 11:
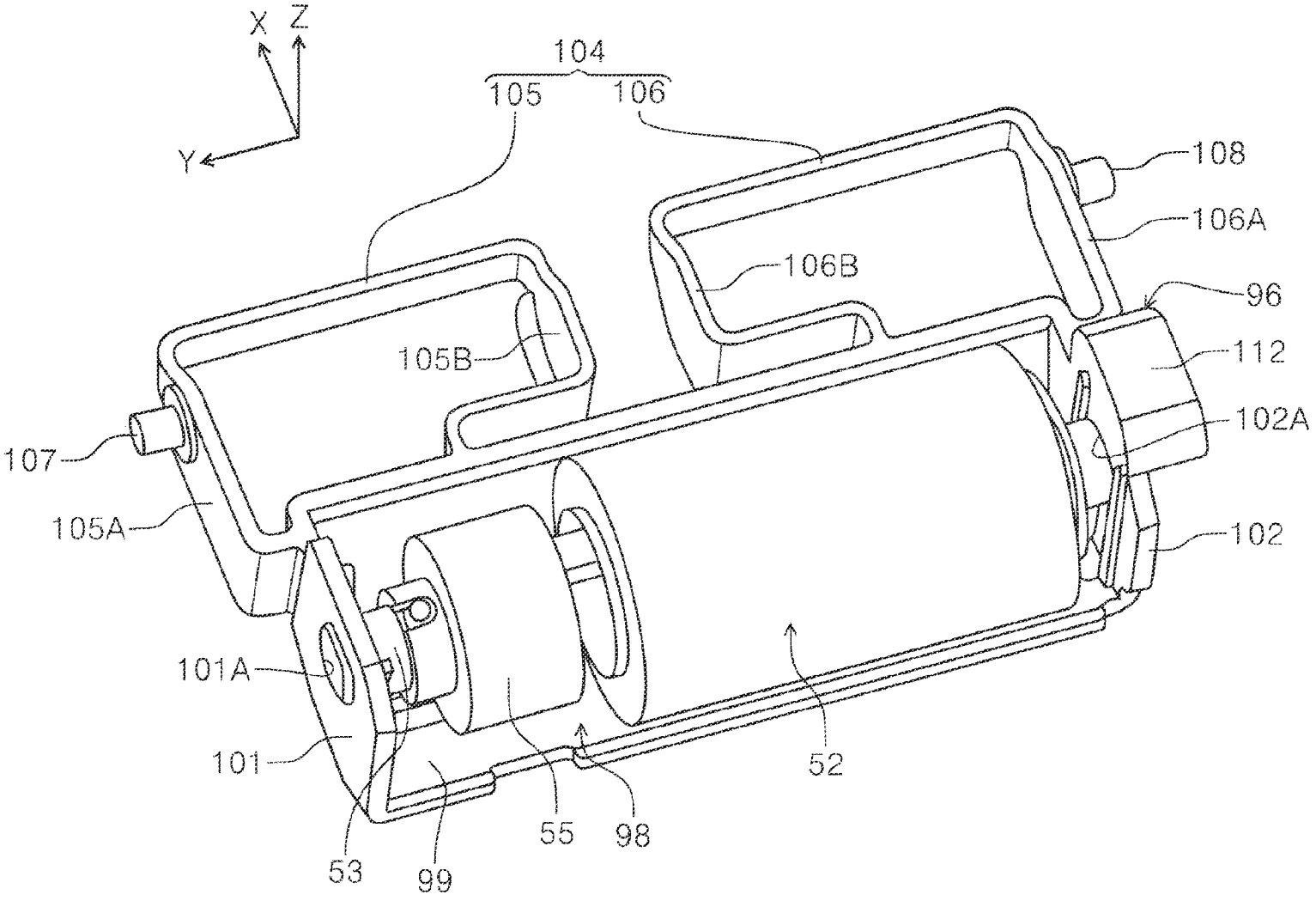
FIG. 11 is a perspective view illustrating a state in which a retard roller is assembled to a first holder of the feeding unit according to the embodiment.

As illustrated in FIG. 11, the first holder 96 includes a roller accommodating section 98, a pinching section 104, coupling pins 107 and 108, and the operation section 112. The first holder 96 holds the retard roller 52 and the torque limiter 55.

The roller accommodating section 98 has a hemicylindrical shape and is a portion that is open in the +Z direction and the −X direction. The roller accommodating section 98 includes the curved wall 99, a left side wall 101, and a right side wall 102.

The curved wall 99 is formed so as to be able to accommodate a portion of the retard roller 52.

The left side wall 101 stands upright in the X-Z plane in the end portion of the curved wall 99 in the +Y direction. A through hole 101A is formed in the left side wall 101. A D-cut section of the shaft section 53 is inserted into the through hole 101A.

The right side wall 102 stands upright in the X-Z plane in the end portion of the curved wall 99 in the −Y direction. A through hole 102A is formed in the right side wall 102. A round portion of the shaft section 53 is inserted into the through hole 102A.

The pinching section 104 is constituted by, for example, a cylindrical section 105 and a cylindrical section 106.

The cylindrical section 105 is formed as an L-shaped angular cylinder when viewed in the Z direction and is provided in a portion in the +Y direction and the +X direction of the center of the curved wall 99 in the Y direction. Moreover, the cylindrical section 105 includes an outer wall 105A positioned in the +Y direction and an inner wall 105B positioned in the −Y direction. The outer wall 105A is provided with the coupling pin 107 having a cylindrical shape. The coupling pin 107 protrudes from the outer wall 105A in the +Y direction.

The cylindrical section 106 is formed as an L-shaped angular cylinder when viewed in the Z direction and is provided in a portion in the −Y direction and the +X direction of the center of the curved wall 99 in the Y direction. Moreover, the cylindrical section 106 includes an outer wall 106A positioned in the −Y direction and an inner wall 106B positioned in the +Y direction. The outer wall 106A is provided with the coupling pin 108 having a cylindrical shape. The coupling pin 108 protrudes from the outer wall 106A in the −Y direction.

In this instance, when the inner wall 105B and the inner wall 106B are pinched and approach each other in the Y direction, the cylindrical section 105 and the cylindrical section 106 elastically deform, and the coupling pin 107 and the coupling pin 108 move so as to approach each other in the Y direction.

The operation section 112 is provided at, for example, a position in the +Z direction of the shaft section 53 in the end portion of the right side wall 102 in the +Z direction. The operation section 112 protrudes from the right side wall 102 in the +Z direction and protrudes in the −Y direction further than the right side wall 102. Further, when viewed in the −Y direction, the operation section 112 has a shape obtained from a single plate bent at plural portions. Accordingly, when receiving an external force that acts on at least the shaft section 53, the operation section 112 transfers the external force to the roller accommodating section 98 and the pinching section 104 and causes the roller accommodating section 98 and the pinching section 104 to rotate with the coupling pins 107 and 108 as the center.

Note that, when the operation section 112 is operated in the −Z direction, the retard roller 52 separates from the feeding roller 46 (FIG. 1).

Figure 12:
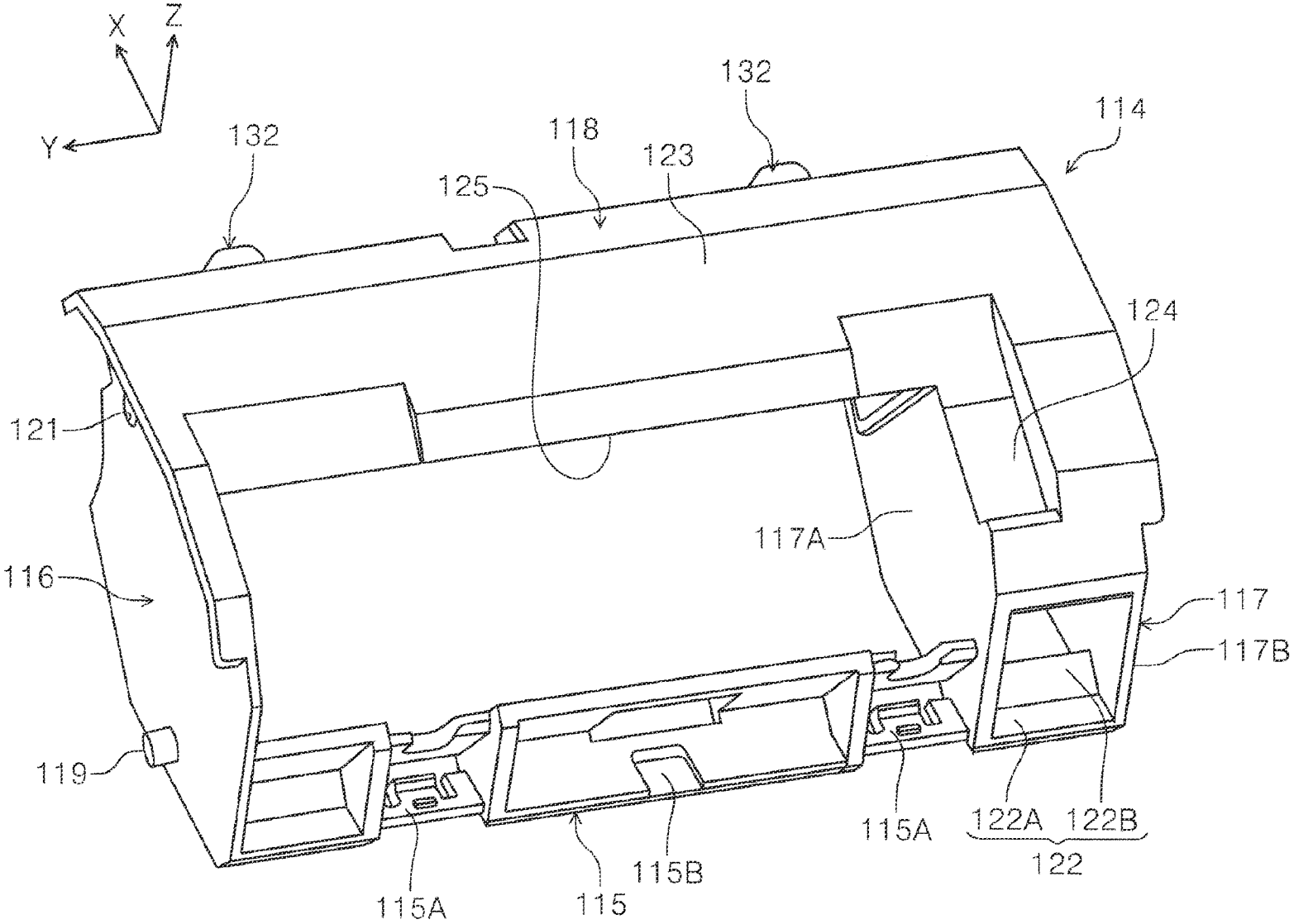
FIG. 12 is a perspective view illustrating a front side of a second holder of the feeding unit according to the embodiment.

As illustrated in FIG. 12, the second holder 114 includes, for example, a front frame 115, a left frame 116, a right frame 117, and an upper frame 118.

The front frame 115 constitutes a portion in the −X direction and the −Z direction of the center of the second holder 114. Moreover, the front frame 115 extends in the Y direction. Two attachment sections 115A to which a sheet metal member 103 (FIG. 10) is attached are formed in the front frame 115. A recess 115B is formed in the center portion of the front frame 115 in the Y direction. One end portion of a coil spring 146 (FIG. 10) described below comes into contact with the recess 115B.

The left frame 116 is a wall section standing upright in the X-Z plane and is coupled to the end portion of the front frame 115 in the +Y direction. The end portion of the left frame 116 in the −Z direction is formed so as to be able to be in surface contact with the bottom wall 72 and the front wall 75 (FIG. 8) in portions constituting the second restricting section 176. A dowel 119 is provided at a position in the −X direction and the −Z direction in the left frame 116.

The dowel 119 has a cylindrical shape and protrudes from the left frame 116 in the +Y direction. A coupling hole 121 is formed at a position in the +X direction and the +Z direction in the left frame 116. The coupling hole 121 passes through the left frame 116 in the Y direction.

The right frame 117 includes longitudinal walls 117A and 117B which are arranged with a gap therebetween in the Y direction. The longitudinal wall 117A and the longitudinal wall 117B stand upright in the X-Z plane. The longitudinal wall 117A is coupled to the end portion of the front frame 115 in the −Y direction. The longitudinal wall 117B is positioned in the −Y direction of the longitudinal wall 117A. A portion of the longitudinal wall 117A in the −X direction and the −Z direction and a portion of the longitudinal wall 117B in the −X direction and the −Z direction are coupled by an engaged section 122.

The engaged section 122 includes a plate section 122A that extends in the X-Y plane and a bent section 122B that extends obliquely upward from the plate section 122A and that is bent at a substantially right angle. The first restricting section 172 (FIG. 8) described below engages the bent section 122B.

The upper frame 118 has a U-shape which is open in the −X direction when viewed in the Z direction. The upper frame 118 covers the left frame 116 and the right frame 117 in the +Z direction. An upper wall 123 which is a portion of the upper frame 118 couples, in the Y direction, a portion of the left frame 116 in the +X direction and the +Z direction and a portion of the right frame 117 in the +X direction and the +Z direction.

A recessed section 124 that is recessed toward the longitudinal wall 117A is formed in a portion of the upper frame 118 in the −Y direction.

Note that a space enclosed by the front frame 115, the left frame 116, the longitudinal wall 117A, and the upper wall 123 is an opening section 125.

Figure 13:
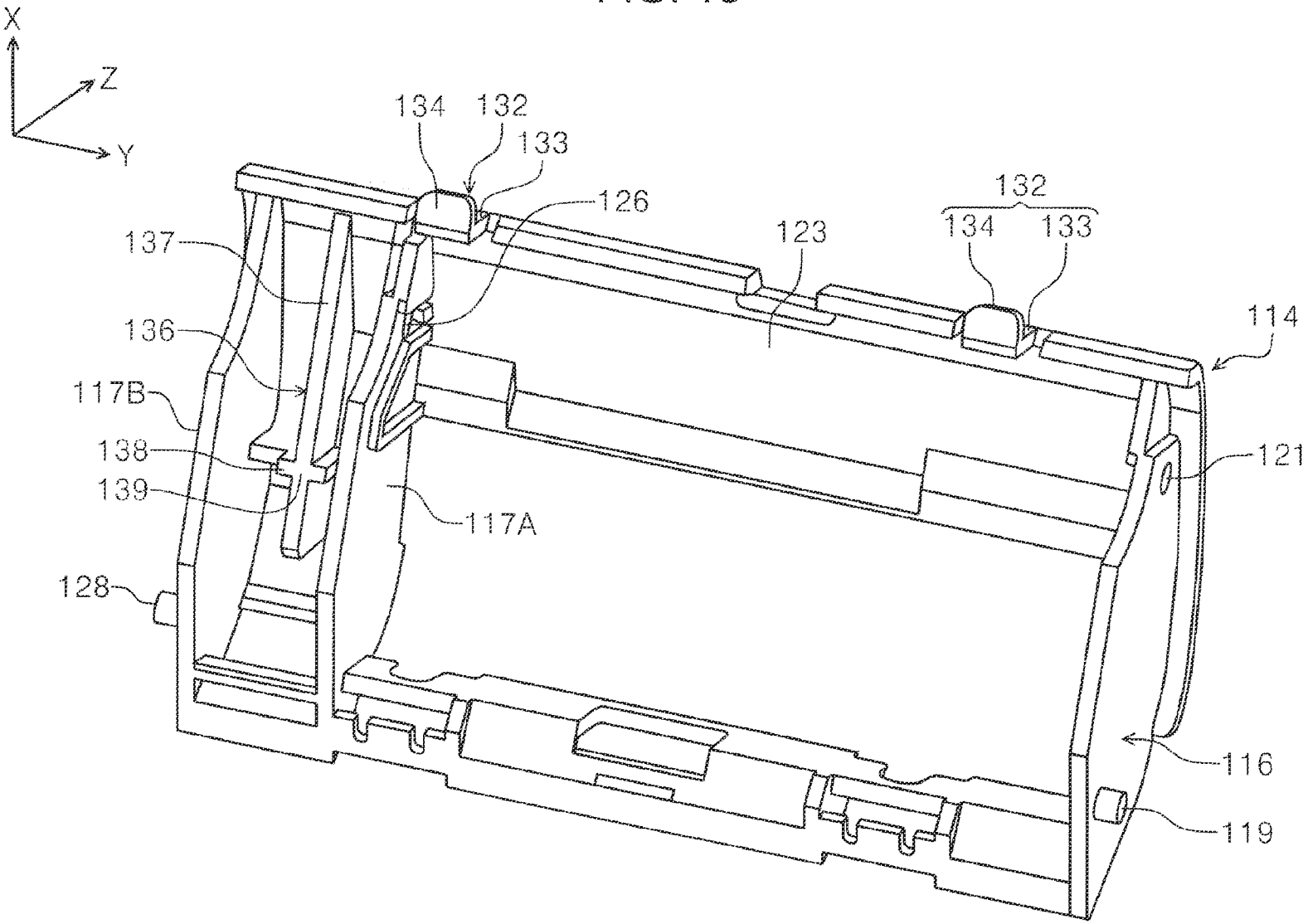
FIG. 13 is a perspective view illustrating a rear side of the second holder of the feeding unit according to the embodiment.

FIG. 13 illustrates the second holder 114 when viewed from the −Z direction side.

A coupling hole 126 is formed at a position in the +X direction and the +Z direction in the longitudinal wall 117A. The coupling hole 126 passes through the longitudinal wall 117A in the Y direction. The coupling hole 126 is arranged coaxially with the coupling hole 121.

A dowel 128 is provided at a position in the −X direction and the −Z direction in the longitudinal wall 117B. The dowel 128 has a cylindrical shape and protrudes from the longitudinal wall 117B in the −Y direction. The dowel 128 is arranged coaxially with the dowel 119.

Two protruding sections 132 are provided in the end portion of the upper wall 123 in the +X direction. The two protruding sections 132 are arranged with a gap therebetween in the Y direction.

Each of the protruding sections 132 includes, for example, a plate section 133 that extends from the upper wall 123 in the −Z direction and a protrusion 134 that protrudes in the +X direction from the end portion of the plate section 133 in the −Z direction. In this manner, the protruding section 132 has an L-shape when viewed in the Y direction. The plate section 133 is able to elastically deform in the X direction. The protrusion 134 includes a tip end portion having a trapezoidal shape when viewed in the Z direction.

The protruding section 132 is pivotable with respect to the edge section 88 (FIG. 9) while retaining a state of being in contact with the edge section 88. In other words, when viewed in the Y direction, the protruding section 132 functions as a rocking fulcrum of the holder section 94.

In the upper wall 123, a pressed section 136 is provided between the longitudinal wall 117A and the longitudinal wall 117B.

The pressed section 136 extends from the upper wall 123 in the −Z direction. Moreover, the pressed section 136 includes, for example, a longitudinal plate 137 that extends in the X-Z plane and a lateral plate 138 that extends in the Y-Z plane. The longitudinal plate 137 and the lateral plate 138 intersect each other. A pressed surface 139 having a cross shape when viewed from the −Z direction side is formed in the end portions of the longitudinal plate 137 and the lateral plate 138 in the −Z direction.

The pressing section 152 (FIG. 9) described below comes into contact with region K1 (FIG. 15) of the pressed surface 139, which has a T-shape when viewed from the −Z direction side. In this manner, the pressed section 136 is a portion pressed by the pressing section 152 in the +Z direction.

In FIGS. 11 and 13, when the coupling pin 107 is inserted into the coupling hole 121 and when the coupling pin 108 is inserted into the coupling hole 126, the first holder 96 is coupled to the second holder 114. When an external force acts on the first holder 96, the coupling pin 107 and the coupling pin 108 rotate toward one side or the other side in the rotational direction, and the first holder 96 thus rocks.

As illustrated in FIG. 10, the sheet metal member 103 is attached to the attachment section 115A of the front frame 115. A threaded hole 103A is formed in the sheet metal member 103. A screw 109 is able to be screwed into the threaded hole 103A. In this case, the guide plate 142 is attached to the second holder 114. Moreover, the second holder 114 is provided with the changing section 145.

The guide plate 142 is an example of a guiding member and guides the sheet P toward the feeding roller 46 (FIG. 1) in a state of being attached to the second holder 114. Specifically, the guide plate 142 has a rectangular shape in which the dimension in the Y direction is longer than the dimension in the Z direction.

Two elongated holes 143 are formed in portions in the −Z direction of the center in the guide plate 142. Each of the two elongated holes 143 is elongated in the Z direction. The two elongated holes 143 are arranged with a gap therebetween in the Y direction such that each of the two elongated holes 143 is able to communicate with a corresponding one of the two threaded holes 103A.

A flange section 142A that extends in the +X direction is formed in the end portion of the guide plate 142 in the +Z direction. The flange section 142A is able to support a portion of the sheet P. Moreover, a plurality of ribs 142B protruding in the −X direction are formed on the surface of the guide plate 142 in the −X direction.

The changing section 145 is able to change a position of the guide plate 142 in a direction intersecting the Y direction. In the present embodiment, the intersecting direction is set as, for example, an oblique direction intersecting both the +Z direction and the +X direction. Moreover, the intersecting direction is a direction intersecting the transport direction of the sheet P when viewed in the Y direction. Specifically, the changing section 145 includes the coil spring 146, which is an example of a third pressing section.

One end portion of the coil spring 146 in the axial direction is attached to the recess 115B. The coil spring 146 is able to elastically deform with the intersecting direction as its axial direction.

When the end portion of the guide plate 142 in the −Z direction comes into contact with the other end portion of the coil spring 146 in the axial direction, the coil spring 146 presses the guide plate 142 against the feeding roller 46 (FIG. 1).

Here, when an external force that resists a pressing force from the coil spring 146 acts on the guide plate 142, the guide plate 142 moves to a position at which the pressing force and the external force are in balance. When the magnitude of the external force changes in this state, the position of the guide plate 142 in the intersecting direction changes. After the position of the guide plate 142 in the intersecting direction is determined, the screw 109 is inserted into each of the elongated holes 143 and screwed in the corresponding threaded hole 103A, and the guide plate 142 is thus attached to the second holder 114. Note that the guide plate 142 is positioned in a state in which a spacer having a predetermined thickness is held between the feeding roller 46 and the guide plate 142.

As illustrated in FIG. 9, the pressing section 152 is an example of a first pressing section and includes a coil spring 154 and a cap 156.

The coil spring 154 is arranged such that the axial direction thereof extends substantially in the Z direction. The end portion of the coil spring 154 in the −Z direction is attached to a portion of the base guide 62. Moreover, the coil spring 154 extends in the +Z direction from the through hole 73 between the two guide walls 74.

The cap 156 is a cuboid hollow member in which a portion in the −Z direction is open. The center portion and the end portion of the coil spring 154 in the +Z direction are accommodated in and attached to the cap 156. Accordingly, a pressing force of the coil spring 154 in the +Z direction acts on the cap 156. Note that, since the cap 156 is held between the two guide walls 74, movement of the cap 156 in the Y direction is restricted, and the cap 156 is guided in the Z direction.

The end portion of the cap 156 in the +Z direction has a contact surface 157 extending substantially in the X-Y plane. When coming into contact with the pressed surface 139 (FIG. 13) of the second holder 114, the contact surface 157 presses the second holder 114 in the +Z direction. The +Z direction is an example of a retreating direction in which the holder section 94 separates from the accommodating section 70. The −Z direction is an example of a direction opposite to the retreating direction.

In this manner, the pressing section 152 presses the holder section 94 in the +Z direction.

Figure 14:
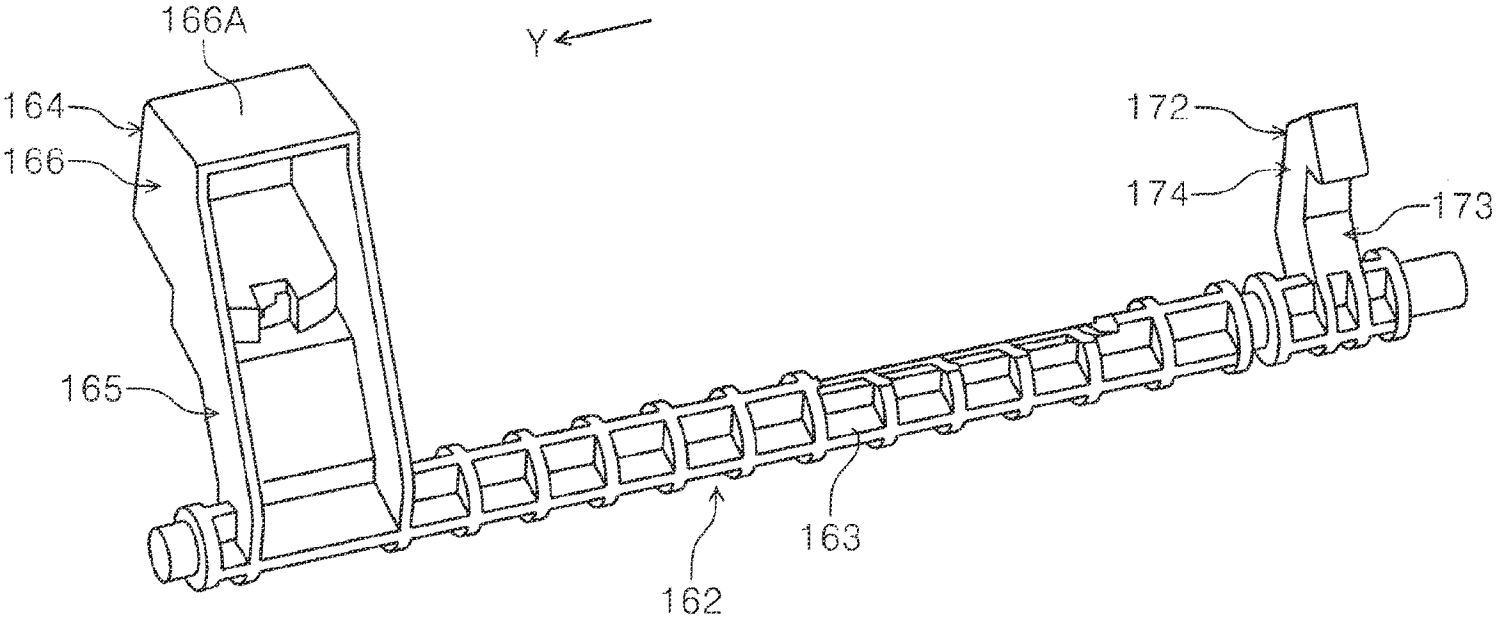
FIG. 14 is a perspective view of a release lever of the feeding unit according to the embodiment.

As illustrated in FIG. 14, the release lever 162 includes, for example, a shaft section 163, the releasing section 164, and the first restricting section 172.

The shaft section 163 extends in the Y direction. Both end portions of the shaft section 163 in the Y direction have a cylindrical shape. Moreover, the both end portions of the shaft section 163 in the Y direction are rotatably supported by a supporting section (not illustrated) provided in the base guide 62 (FIG. 8). Further, the shaft section 163 is provided with a torsion spring (not illustrated). Accordingly, a pressing force that presses the first restricting section 172 described below toward a restricting position acts on the shaft section 163.

The releasing section 164 includes an arm section 165 extending in the radial direction of the shaft section 163 from the end portion of the shaft section 163 in the +Y direction and a pressing section 166 provided in the tip end portion of the arm section 165.

The pressing section 166 includes a pressing surface 166A. The pressing surface 166A is exposed in the through hole 67 (FIG. 7) of the base guide 62. When the pressing surface 166A is pressed down in the −Z direction, the shaft section 163 rotates. At this time, the rotational direction of the shaft section 163 is a direction in which the first restricting section 172 separates from the second holder 114. In this manner, the releasing section 164 causes the first restricting section 172 to move to a releasing position.

The first restricting section 172 includes, for example, an extending section 173 extending from the −Y-direction end portion of the shaft section 163 in the radial direction of the shaft section 163 and an engaging section 174 provided in the extending section 173. The first restricting section 172 width in the Y direction is narrower than the releasing section 164 width in the Y direction.

The engaging section 174 is a portion having an L-shape when viewed in the Y direction. Moreover, the engaging section 174 passes through the through hole 73 (FIG. 9) and protrudes to the inside of the accommodating section 70. The engaging section 174 then engages the bent section 122B (FIG. 12) of the engaged section 122. When the engaging section 174 engages the engaged section 122, movement of the holder section 94 in the +Z direction is restricted.

In this manner, the first restricting section 172 is provided so as to be movable between the restricting position at which the first restricting section 172 restricts movement of the second holder 114 in the retreating direction in the accommodating section 70 and the releasing position at which the first restricting section 172 is separated from the restricting position.

As illustrated in FIG. 8, the cap 156 of the pressing section 152 and the engaging section 174 of the first restricting section 172 overlap each other in a range of length L1 in the Y direction. That is, in a state in which the holder section 94 (FIG. 10) is accommodated in the accommodating section 70 and the first restricting section 172 restricts movement of the second holder 114, the pressing section 152 and the first restricting section 172 overlap each other in the Y direction.

The second restricting section 176 is constituted by, for example, an end portion 177 which is on the bottom wall 72 and in the +Y direction with respect to the rib 84 and an end portion 178 which is on the front wall 75 and in the +Y direction with respect to the rib 84. When the left frame 116 (FIG. 12) comes into contact with the second restricting section 176, the second restricting section 176 restricts movement of the +Y-direction end portion of the holder section 94 in the −Z direction.

In this manner, the second restricting section 176 is provided in the accommodating section 70 and restricts movement of the holder section 94 in the direction opposite to the retreating direction.

Figure 15:
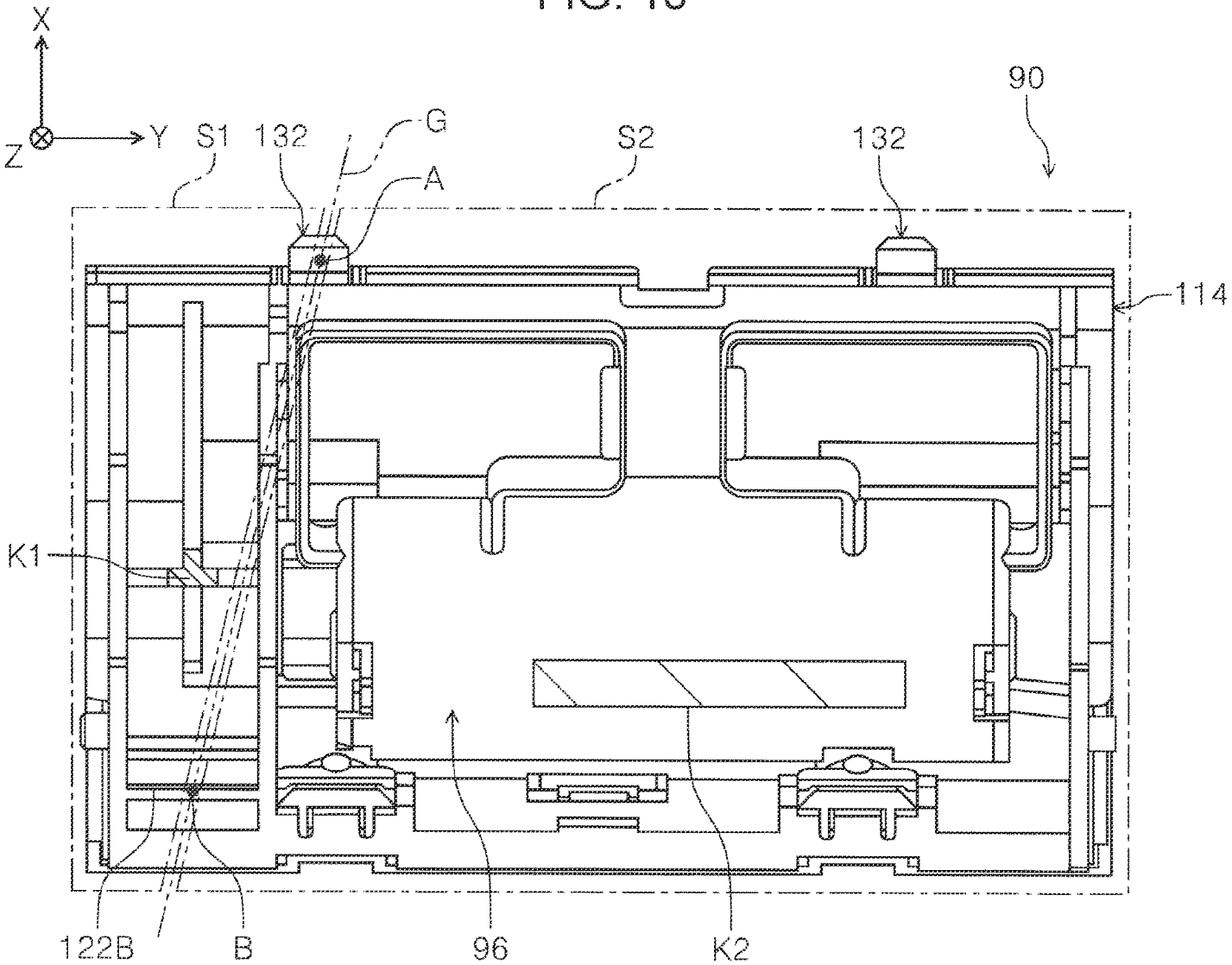
FIG. 15 is a rear view of the attachable/detachable unit of the feeding unit according to the embodiment when viewed from a rear side.

FIG. 15 illustrates the first holder 96 and the second holder 114 when viewed from the −Z direction side.

A position corresponding to the middle point of the −Y-direction-side protruding section 132 in the X direction and the Y direction is indicated by point A. Moreover, a position corresponding to the middle point of the engaging section 174 (FIG. 8) of the first restricting section 172 in the X direction and the Y direction is indicated by point B. Point B also corresponds to the middle point of the bent section 122B in the Y direction. A straight line passing through point A and point B indicates virtual line G. Note that, in FIG. 15, a region in which the contact section 83C (FIG. 8) comes into contact with the first holder 96 is indicated by region K2. The middle point here does not necessarily correspond to exactly the center in a predetermined direction and may include positional deviation to some extent.

A region that includes the entire second holder 114 is region S. Moreover, in region S divided by virtual line G, a region in the −Y direction of virtual line G is a first region S1, and a region in the +Y direction of virtual line G is a second region S2. The area of the first region S1 is smaller than the area of the second region S2.

Region K1 is arranged so as to deviate in the −Y direction with respect to virtual line G. In other words, the pressing section 152 deviates in the −Y direction with respect to virtual line G and is arranged within the first region S1.

Region K2 is arranged so as to deviate in the +Y direction with respect to virtual line G. In other words, the pressing lever 83 deviates in the +Y direction with respect to virtual line G and is arranged within the second region S2.

Note that the second restricting section 176 (FIG. 8) is arranged within the second region S2.

Next, operation of the feeding unit 50 will be described. Although configurations will be described with reference to FIGS. 1 to 15, description of individual drawing number will be omitted in some cases.

When the feeding roller 46 and the retard roller 52 are replaced, the paper feeding tray 21 is opened, and the roller cover 36 is detached. When the roller cover 36 is detached, the releasing section 164 is exposed.

When the operation section 112 of the first holder 96 is pressed down, a state in which the retard roller 52 is pressed against the feeding roller 46 is terminated. The feeding roller 46 is then detached.

Figure 16:
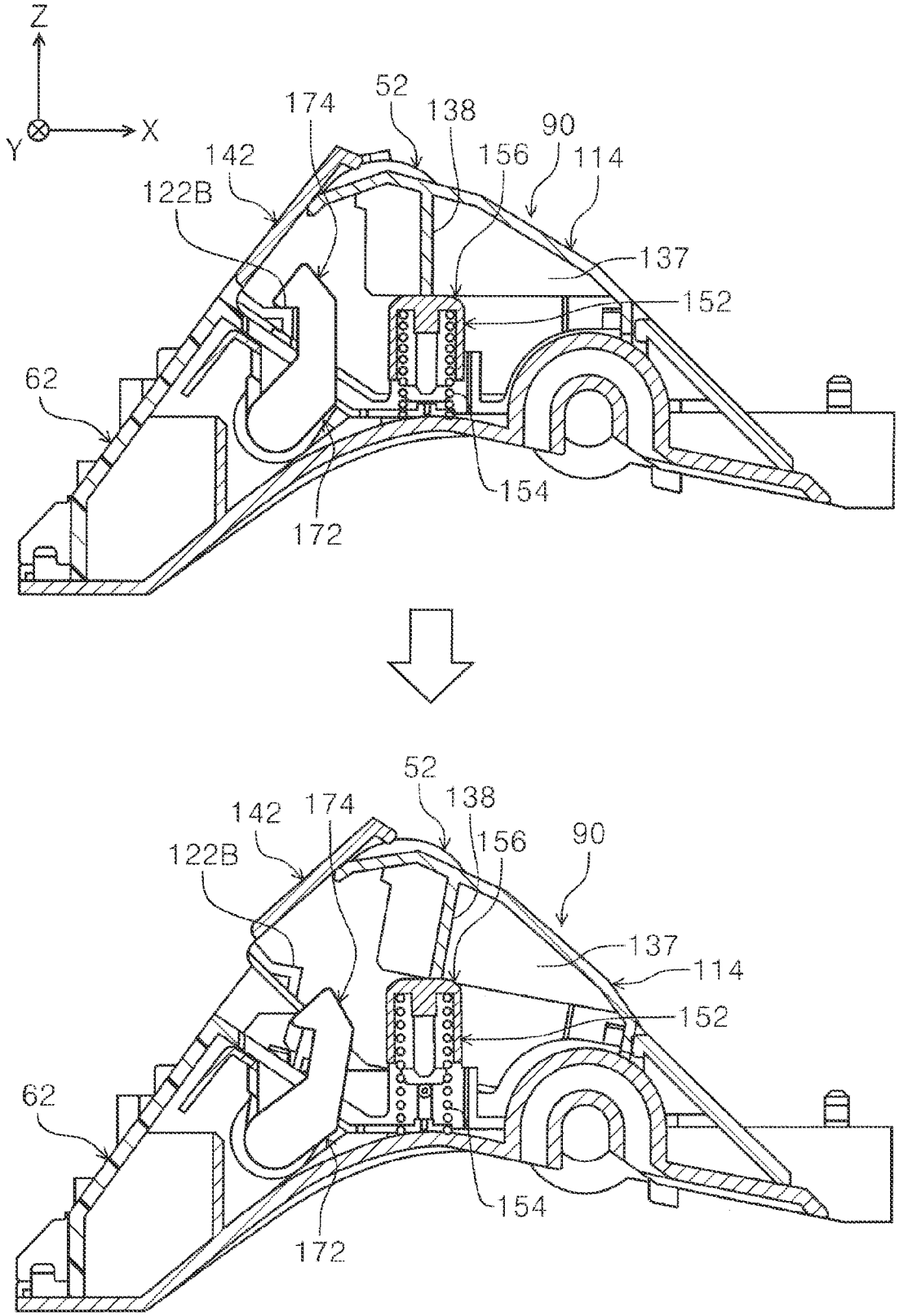
FIG. 16 is a vertical sectional view illustrating a state in which restriction on the attachable/detachable unit is released in the feeding unit according to the embodiment.

Next, as illustrated in FIG. 16, when operation of releasing the releasing section 164 (FIG. 7) is performed, the first restricting section 172 moves to the retreating position separated from the second holder 114. At this time, since a pressing force from the pressing section 152 acts on the second holder 114, the attachable/detachable unit 90 is brought into a state of being raised in the +Z direction. Specifically, the upstream portion of the attachable/detachable unit 90 in the feeding direction of the sheet P is pushed up.

In the −Z direction and the +Z direction of the attachable/detachable unit 90 which is pushed up, gripping spaces D1 and D2 (FIG. 4) used for attaching/detaching the attachable/detachable unit 90 are formed. The attachable/detachable unit 90 is then detached.

Subsequently, the first holder 96 is detached from the second holder 114. At this time, the retard roller 52 and the torque limiter 55 are also detached together. A new first holder 96, a new retard roller 52, and a new torque limiter 55 are then attached to the second holder 114.

Figure 17:
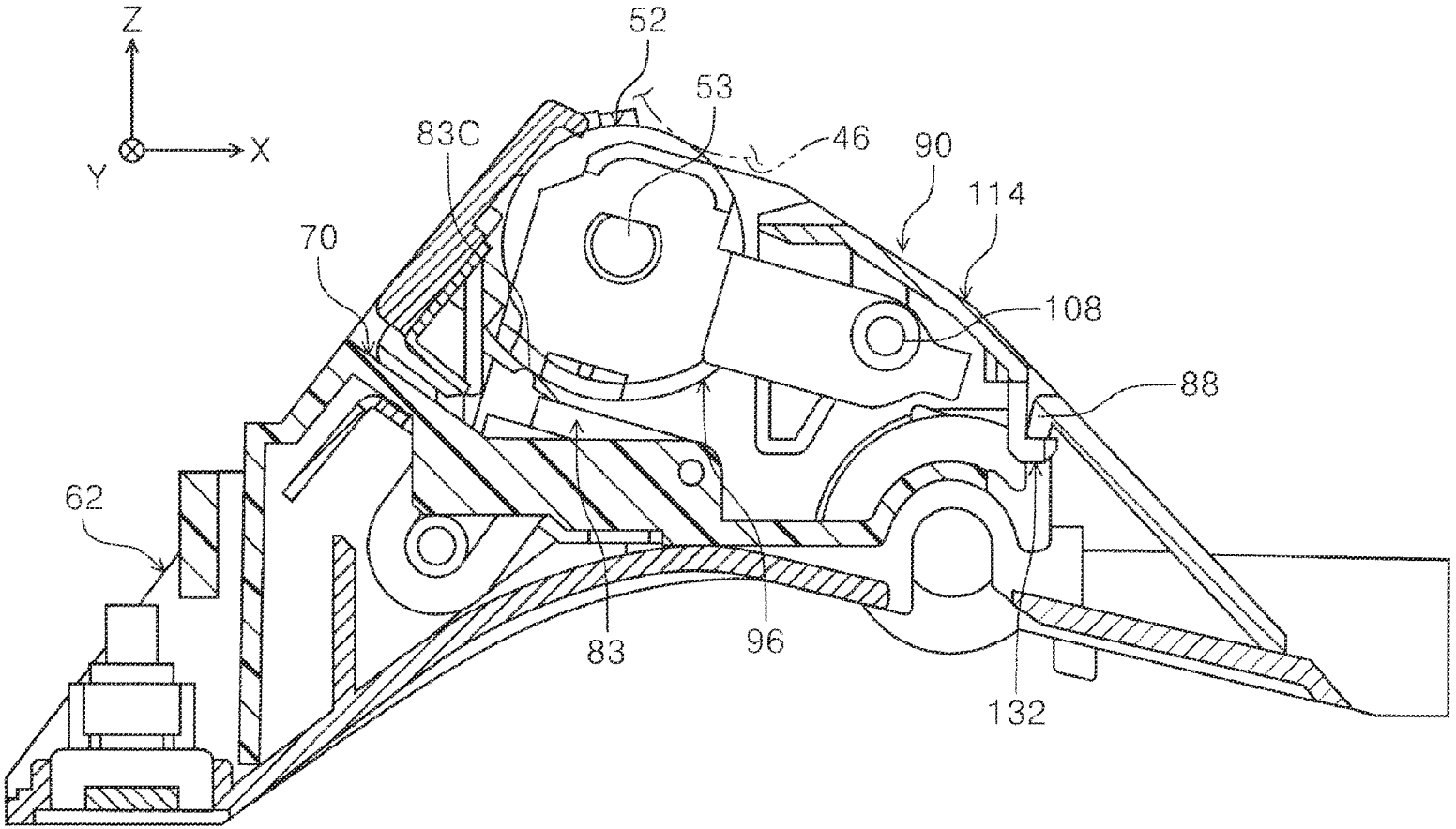
FIG. 17 is a vertical sectional view illustrating a state in which the attachable/detachable unit is attached to the base guide of the feeding unit according to the embodiment.
Figure 18:
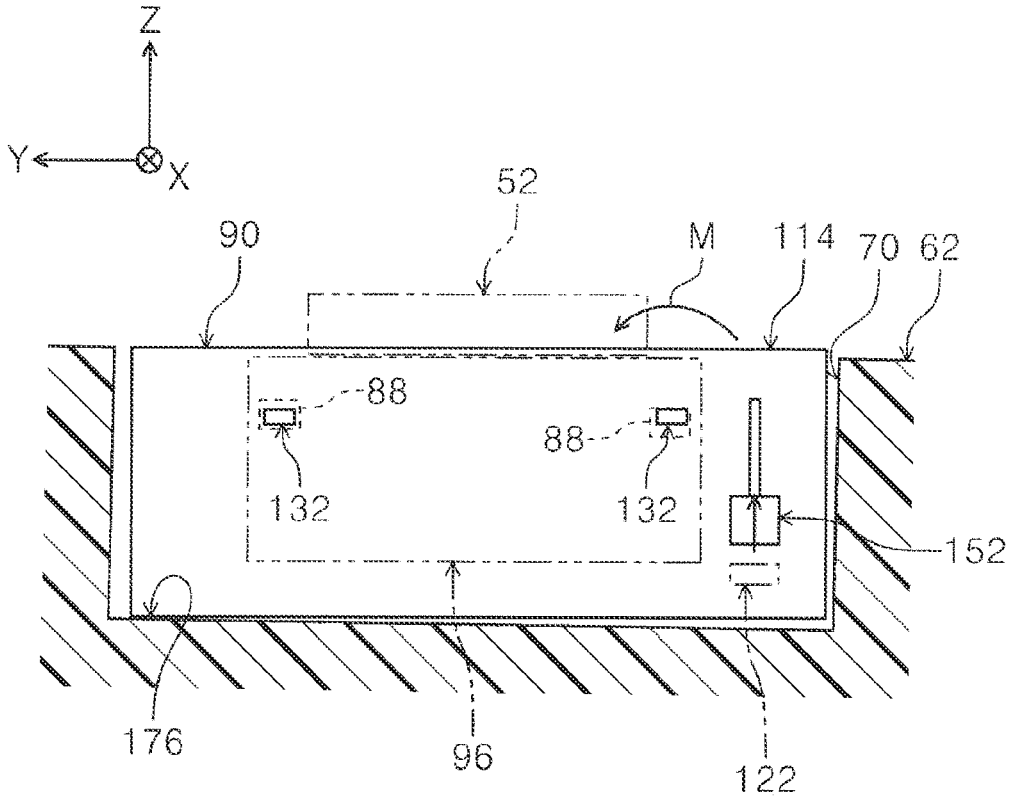
FIG. 18 is a schematic view illustrating a state in which a moment that acts on the attachable/detachable unit in an attached state is restricted by a second restricting section in the feeding unit according to the embodiment.
Figure 19:
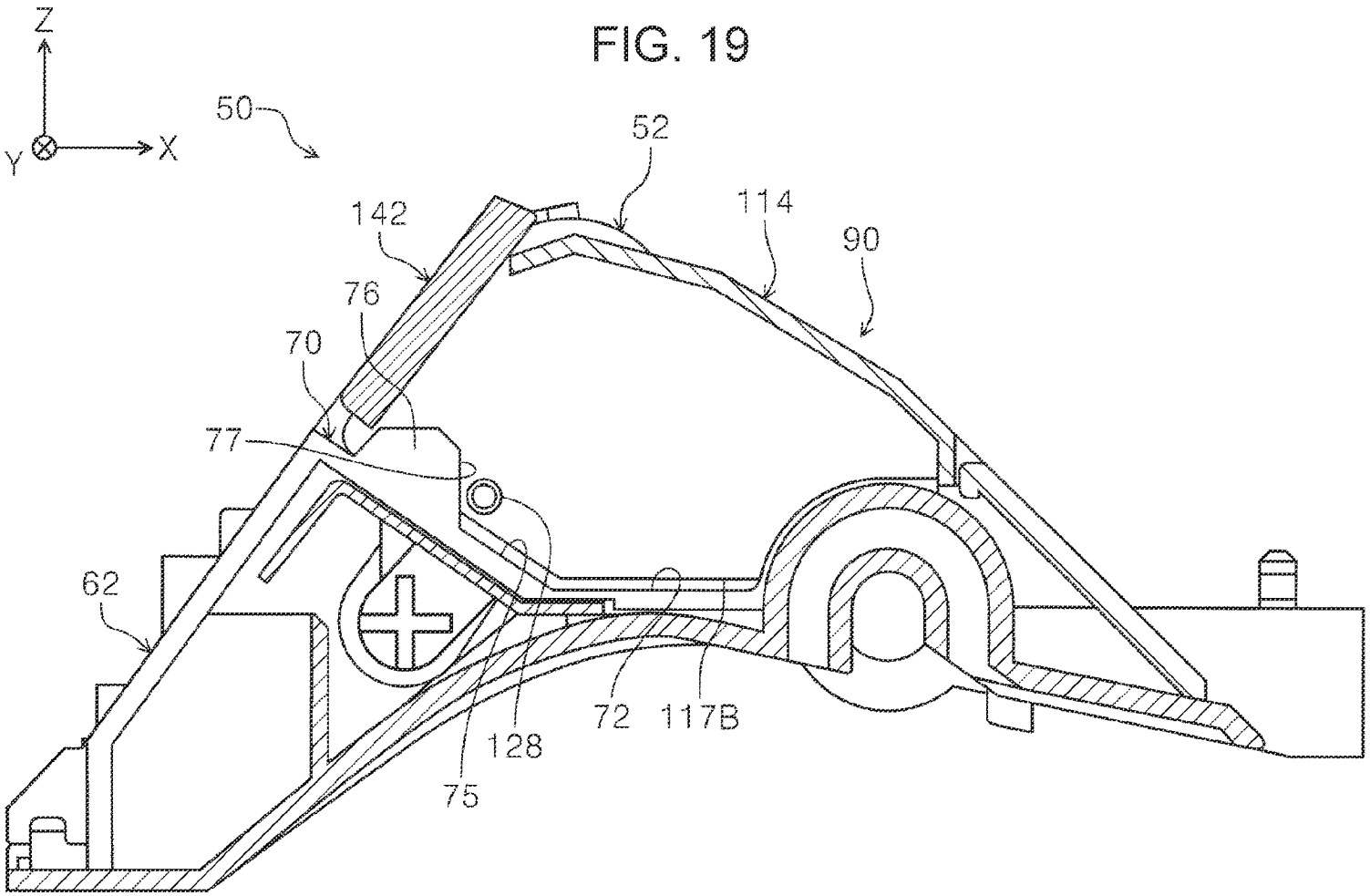
FIG. 19 is a vertical sectional view of a side portion of the attachable/detachable unit in the attached state in the feeding unit according to the embodiment when viewed from one side.
Figure 20:
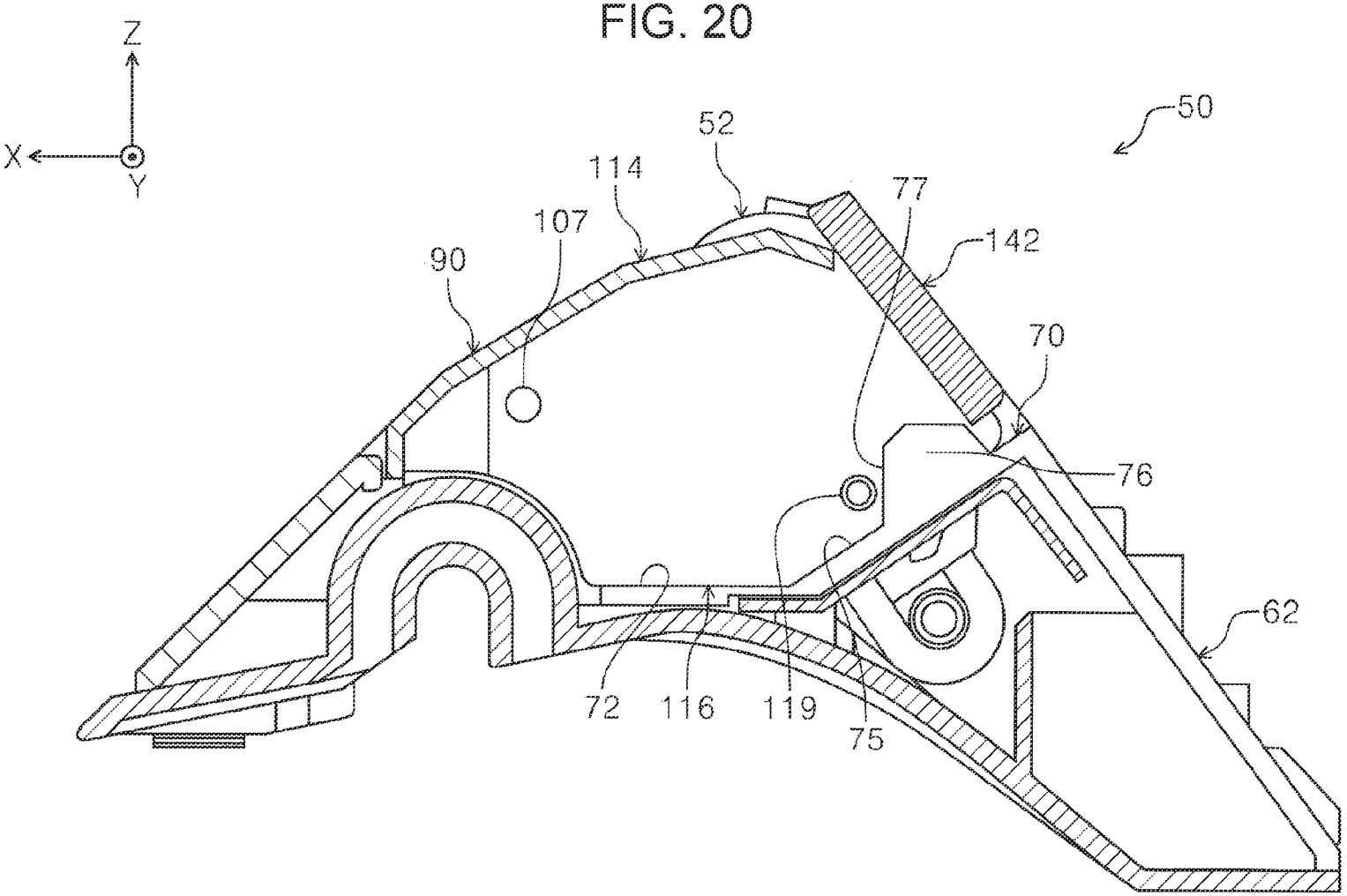
FIG. 20 is a vertical sectional view of a side portion of the attachable/detachable unit in the attached state in the feeding unit according to the embodiment when viewed from the other side.

Next, as illustrated in FIG. 17, the edge section 88 comes into contact with the protruding section 132. This enables the entire attachable/detachable unit 90 to rock in the X-Z plane. Here, when the engaging section 174 engages the bent section 122B, movement of the second holder 114 in the +Z direction is restricted. That is, the attachable/detachable unit 90 is accommodated in and attached to the accommodating section 70.

Next, the feeding roller 46 is attached in a state in which the operation section 112 of the first holder 96 is pushed down.

Subsequently, the roller cover 36 is attached to the door section 17, and the replacing operation then ends.

As illustrated in FIGS. 15, 16, 18, 19, and 20, in a state in which the attachable/detachable unit 90 is attached to the accommodating section 70, the pressing section 152 tries to push up the −Y-direction end portion of the second holder 114 in the +Z direction. Accordingly, moment M acts on the second holder 114.

At this time, the protruding section 132 is positioned in the +X direction of the pressing section 152. The engaged section 122 is positioned in the −X direction of the pressing section 152. Accordingly, in the first region S1 described above, the pressing force from the pressing section 152 causes the protruding section 132 and the edge section 88 to be in contact with each other and causes the engaged section 122 and the engaging section 174 to be in contact with each other, and the pressing force and a reaction force are in balance.

On the other hand, in the second region S2, the second holder 114 is pressed in the −Z direction due to the moment M, the weight of the second holder 114, and the like.

A portion of the pressed second holder 114 in the +Y direction comes into contact with the second restricting section 176, and movement of the portion in the −Z direction is therefore restricted.

In this manner, since the second holder 114 is positioned with respect to the base guide 62 in a state in which a backlash is reduced, it is unnecessary to adjust the position of the second holder 114 after replacement.

The pressing force from the coil spring 85 acts, as a load, on a nip portion of the retard roller 52 and the feeding roller 46 via the first holder 96. In this case, the pressing direction of the coil spring 85 is directed to the center of rotation of the retard roller 52. Accordingly, substantially all of the pressing force from the coil spring 85 acts as the load on the nip portion. Accordingly, influence of a component force that acts on the second holder 114 via the rocking fulcrum of the first holder 96 is reduced. Such operation makes it possible to suppress the pressing force from the coil spring 85 from affecting positioning of the second holder 114.

Moreover, the pressing force from the pressing section 152 acts between the second holder 114 and the base guide 62. It is therefore possible to suppress the pressing force from the pressing section 152 from affecting the load on the nip portion of the retard roller 52 and the feeding roller 46.

As described above, according to the feeding unit 50, the pressing section 152 is arranged so as to deviate in the −Y direction with respect to virtual line G. Accordingly, the rotational direction of the holder section 94 rotating about the protruding section 132 is determined to a single direction.

Moreover, the pressing force that acts on the holder section 94 from the pressing section 152 retains a state in which the protruding section 132 and the edge section 88 are in contact with each other. That is, the position of the center of rotation of the holder section 94 is suppressed from deviating.

Further, movement of the holder section 94 in the retreating direction is restricted by the first restricting section 172, movement of the holder section 94 in the direction opposite to the retreating direction is restricted by the second restricting section 176, and the holder section 94 is thereby positioned at a predetermined position.

Here, since the holder section 94 is positioned at the predetermined position each time the holder section 94 and the retard roller 52 are attached to or detached from the accommodating section 70, the position of the holder section 94 with respect to the feeding unit 50 does not change before and after the retard roller 52 is replaced, and it is possible to suppress the position of the retard roller 52 from changing each time the retard roller 52 is replaced.

According to the feeding unit 50, since the first holder 96 that holds the retard roller 52 is pivotable with respect to the second holder 114, it is possible to change the position of the retard roller 52. Further, the second pressing section 80 is provided separately from the pressing section 152 and is thus able to press the retard roller 52 against the feeding roller 46 regardless of a pressing state of the first holder 96.

According to the feeding unit 50, when the second holder 114 is accommodated in the accommodating section 70, the second holder 114 is positioned at a predetermined position, and the guide plate 142 is thus positioned upstream of the feeding roller 46 in the feeding direction of the sheet P. Accordingly, it is unnecessary to separately perform operation of adjusting the position at which the guide plate 142 is attached, after the second holder 114 is accommodated in the accommodating section 70. That is, even when the second holder 114 is detached from the accommodating section 70 to replace the retard roller 52, the position of the second holder 114 with respect to the feeding unit 50 does not change before and after the retard roller 52 is replaced, and it is thus unnecessary to separately perform the operation of adjusting the position at which the guide plate 142 is attached, after the retard roller 52 is replaced.

According to the feeding unit 50, since the position of the guide plate 142 in the intersecting direction is able to be changed, it is possible to provide the guide plate 142 in the second holder 114 such that the leading end of the sheet P advances toward the nip portion which is a contact portion of the retard roller 52 and the feeding roller 46.

According to the feeding unit 50, when the position of the guide plate 142 is changed, the pressing force that acts on the guide plate 142 from the coil spring 146 resists the gravity that acts on the guide plate 142. Accordingly, the guide plate 142 is supported by the coil spring 146, and it is thus possible to facilitate changing the position of the guide plate 142.

According to the feeding unit 50, the pressing section 152 is arranged on one side with respect to virtual line G, and the second restricting section 176 is arranged on the other side with respect to virtual line G. In other words, since a portion of the second holder 114, which is pressed, and a portion of the second holder 114, at which movement is restricted, are able to be arranged so as to be apart from each other, it is possible to stabilize a posture of the second holder 114.

Since the first holder 96 holds the retard roller 52, the first holder 96 is necessarily arranged in the larger one of the first region S1 and the second region S2.

In this case, according to the feeding unit 50, compared with a configuration in which the pressing section 152 is arranged in the larger one of the first region S1 and the second region S2, it is possible to arrange the pressing section 152 so as to be apart from the first holder 96, thus making it possible to suppress the pressing section 152 from coming into contact with the first holder 96.

According to the feeding unit 50, compared with a configuration in which the pressing section 152 and the first restricting section 172 are arranged so as to deviate in the Y direction, it is possible to suppress another moment around a line passing through the pressing section 152 and the first restricting section 172 from affecting positioning of the second holder 114.

According to the feeding unit 50, since the roller cover 36 covers the releasing section 164 in a state in which the roller cover 36 is attached to the door section 17, it is possible to suppress erroneous operation of releasing the releasing section 164. Note that, by detaching the roller cover 36 from the door section 17, it is possible to perform the operation of releasing the releasing section 164.

According to the feeding unit 50, when the operation section 112 of the first holder 96 is operated, the retard roller 52 separates from the feeding roller 46. Accordingly, it is unnecessary to grasp the entire first holder 96 to operate the first holder 96, thus making it possible to facilitate operation of replacing the feeding roller 46 or the retard roller 52.

Although the feeding unit 50 according to the embodiment of the disclosure basically has the above-described configuration, it is of course possible to, for example, partially change or omit the configuration without departing from the gist of the disclosure of the present application.

In the feeding unit 50, the holder section 94 may be constituted by a single holder. Further, the second pressing section 80 is not necessarily provided.

The guide plate 142 is not necessarily provided in the second holder 114. For example, a guiding section that guides the sheet P may be formed in the second holder 114.

At this time, since the holder section 94 is positioned at a predetermined position each time the holder section 94 and the retard roller 52 are attached to or detached from the accommodating section 70, the position of the holder section 94 with respect to the feeding unit 50 does not change before and after the retard roller 52 is replaced, and it is therefore possible to suppress the position of the guiding section from changing each time the retard roller 52 is replaced. That is, it is possible to retain accuracy in guiding a sheet constant before and after the retard roller 52 is replaced.

The changing section 145 may be provided in the guide plate 142. Moreover, the changing section 145 may be provided in both the guide plate 142 and the second holder 114. Further, the changing section 145 does not necessarily include the third pressing section such as the coil spring 146. For example, the guide plate 142 may be slid by using a cam member.

Moreover, in the feeding unit 50, the pressing section 152 and the second restricting section 176 may be arranged together in one of the first region S1 and the second region S2. Alternatively, the pressing section 152 may be arranged in the larger one of the first region S1 and the second region S2.

The pressing section 152 and the first restricting section 172 do not necessarily overlap each other in the Y direction.

The door section 17 is not necessarily provided with the roller cover 36.

The first holder 96 is not necessarily provided with the operation section 112.

The first pressing section may be provided in the second holder 114.

Although the releasing section 164 is arranged at a position apart from the first restricting section 172 so as to be hidden by the roller cover 36, when it is unnecessary to hide the releasing section 164, the releasing section 164 may be arranged so as to be close to the first restricting section 172. Alternatively, the releasing section 164 may be provided in the first restricting section 172, and the first restricting section 172 may be directly subjected to a releasing operation.

What is claimed is:

1. A feeding device comprising:

a retard roller that comes into contact with a feeding roller for feeding a medium and that is configured to rotate about a shaft;

at least one holder that rotatably holds the retard roller, the holder includes a first holder that rotatably holds the retard roller and a second holder that holds the first holder in a pivotable position, the second holder includes a guiding member that guides the medium toward the feeding roller;

a protruding section that is provided in the holder and serves as a rocking fulcrum of the holder;

an accommodating section that includes a holding section which holds the protruding section and that accommodates the holder;

a pressing section that presses the holder in a retreating direction in which the holder separates from the accommodating section;

a first restricting section that is provided in the accommodating section and restricts movement of the holder in the retreating direction; and a second restricting section that is provided in the accommodating section and restricts movement of the holder in a direction opposite to the retreating direction, wherein the pressing section is arranged so as to deviate in an axial direction of the retard roller with respect to a virtual line passing through a middle point of the protruding section and a middle point of the first restricting section in the axial direction, and the holder comes into contact with the first restricting section and the second restricting section.

2. The feeding device according to claim 1, further comprising a second pressing section, wherein the pressing section functions as a first pressing section, and the second pressing section presses the first holder such that the feeding roller comes into contact with the retard roller.

3. The feeding device according to claim 2, wherein a changing section configured to change a position of the guiding member in a direction intersecting the axial direction is provided in at least one of the guiding member or the second holder.

4. The feeding device according to claim 3, wherein the changing section includes a third pressing section that presses the guiding member toward the feeding roller.

5. The feeding device according to claim 2, wherein the first pressing section is arranged in one of a first region and a second region that are divided by the virtual line, and the second restricting section is arranged in another of the first region and the second region.

6. The feeding device according to claim 5, wherein the first pressing section is arranged in a smaller one of the first region and the second region.

7. The feeding device according to claim 2, wherein in a state in which the second holder is accommodated in the accommodating section and in which the first restricting section restricts movement of the second holder, the first pressing section and the first restricting section overlap each other in the axial direction.

8. The feeding device according to claim 2, further comprising:

a releasing section; and a cover member, wherein the first restricting section is provided so as to be movable between a restricting position at which the first restricting section restricts movement of the second holder in the accommodating section and a releasing position at which the first restricting section is separated from the restricting position, the releasing section moves the first restricting section to the releasing position, and the cover member covers the releasing section in a state in which the cover member is attached to a device main body.

9. The feeding device according to claim 2, wherein the first holder includes an operation section, and the retard roller separates from the feeding roller when the operation section is operated.

10. A feeding device comprising:

a retard roller that comes into contact with a feeding roller for feeding a medium and that is configured to rotate about a shaft;

at least one holder that rotatably holds the retard roller;

a protruding section that is provided in the holder and serves as a rocking fulcrum of the holder;

an accommodating section that includes a holding section which holds the protruding section and that accommodates the holder;

a pressing section that presses the holder in a retreating direction in which the holder separates from the accommodating section;

a second pressing section;

a first restricting section that is provided in the accommodating section and restricts movement of the holder in the retreating direction; and a second restricting section that is provided in the accommodating section and restricts movement of the holder in a direction opposite to the retreating direction, wherein the pressing section is arranged so as to deviate in an axial direction of the retard roller with respect to a virtual line passing through a middle point of the protruding section and a middle point of the first restricting section in the axial direction, the holder comes into contact with the first restricting section and the second restricting section, the holder includes a first holder that rotatably holds the retard roller and a second holder that holds the first holder in a pivotable position, in a state in which the second holder is accommodated in the accommodating section and in which the first restricting section restricts movement of the second holder, and the pressing section and the first restricting section overlap each other in the axial direction.

11. A feeding device comprising:

a retard roller that comes into contact with a feeding roller for feeding a medium and that is configured to rotate about a shaft;

at least one holder that rotatably holds the retard roller;

a protruding section that is provided in the holder and serves as a rocking fulcrum of the holder;

an accommodating section that includes a holding section which holds the protruding section and that accommodates the holder;

a pressing section that presses the holder in a retreating direction in which the holder separates from the accommodating section;

a second pressing section;

a releasing section;

a cover member;

a first restricting section that is provided in the accommodating section and restricts movement of the holder in the retreating direction; and a second restricting section that is provided in the accommodating section and restricts movement of the holder in a direction opposite to the retreating direction, wherein the pressing section is arranged so as to deviate in an axial direction of the retard roller with respect to a virtual line passing through a middle point of the protruding section and a middle point of the first restricting section in the axial direction, the holder comes into contact with the first restricting section and the second restricting section, the holder includes a first holder that rotatably holds the retard roller and a second holder that holds the first holder in a pivotable position, the pressing section functions as a first pressing section, the second pressing section presses the first holder such that the feeding roller comes into contact with the retard roller, the first restricting section is provided so as to be movable between a restricting position at which the first restricting section restricts movement of the second holder in the accommodating section and a releasing position at which the first restricting section is separated from the restricting position, the releasing section moves the first restricting section to the releasing position, and the cover member covers the releasing section in a state in which the cover member is attached to a device main body.

* * * * *